US011388963B2

(12) United States Patent
Ma

(10) Patent No.: US 11,388,963 B2
(45) **Date of Patent: *Jul. 19, 2022**

(54) TILTABLE UMBRELLA WITH REMOVABLE GUIDE TRACK

(71) Applicant: Zhun-An Ma, Ningbo (CN)

(72) Inventor: Zhun-An Ma, Ningbo (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/006,614

(22) Filed: Aug. 28, 2020

(65) Prior Publication Data

US 2021/0112932 A1 Apr. 22, 2021

Related U.S. Application Data

(63) Continuation of application No. 15/952,618, filed on Apr. 13, 2018, now Pat. No. 10,758,015.

(60) Provisional application No. 62/485,491, filed on Apr. 14, 2017.

(51) Int. Cl.
*A45B 17/00* (2006.01)
*A45B 25/14* (2006.01)

(52) U.S. Cl.
CPC ..... *A45B 17/00* (2013.01); *A45B 2025/146* (2013.01)

(58) Field of Classification Search
CPC ..... A45B 17/00
See application file for complete search history.

(56) References Cited

U.S. PATENT DOCUMENTS

| | | | |
|---|---|---|---|
| 835,306 | A | 11/1906 | Mangelsdorf |
| 878,270 | A | 2/1908 | Blake et al. |
| 956,657 | A | 5/1910 | Wetteroth |
| 957,528 | A | 5/1910 | Wetteroth |
| D45,227 | S | 2/1914 | Glauber |
| 1,136,887 | A | 4/1915 | Penn |
| 1,235,296 | A | 7/1917 | Dillingham |
| 1,243,594 | A | 10/1917 | Dillingham |
| 1,255,627 | A | 2/1918 | Morrow et al. |

(Continued)

FOREIGN PATENT DOCUMENTS

| | | |
|---|---|---|
| AT | 128258 | 5/1932 |
| BG | 6965-0001 | 4/2009 |

(Continued)

OTHER PUBLICATIONS

Operation Manual Easy Sun Parasol Sunshade (Issue: Jul. 2004) pp. 1-17.

*Primary Examiner* — David R Dunn
*Assistant Examiner* — Danielle Jackson
(74) *Attorney, Agent, or Firm* — Knobbe, Martens, Olson & Bear, LLP

(57) ABSTRACT

A tilt device for an umbrella is a guide track assembly disposed in one of a first tilt member and a second tilt member. The guide track assembly has a first guide track member and a second guide track member. An enclosed guide track is within the guide track assembly. The guide track assembly is slideably received within the first tilt member. A driver that has an upper portion disposed in the second tilt member and a lower portion. The lower portion is disposed in the enclosed guide track. The enclosed guide track is configured to guide movement of the lower portion of the driver within the first tilt member. Movement of the driver causes the second tilt member to tilt relative to the first tilt member. The guide track assembly includes an open channel forming a part of a cord channel through the tilt device.

16 Claims, 15 Drawing Sheets

(56) References Cited

U.S. PATENT DOCUMENTS 1,268,354 A 6/1918 Howard
1,801,913 A 4/1931 Frederick
D90,772 S 9/1933 Kasch
2,223,253 A 11/1940 Hamilton
D127,735 S 6/1941 Dreyfuss
2,447,972 A 8/1948 Weinert
2,462,560 A 2/1949 Schmidt
2,475,406 A 7/1949 Russell
D162,678 S 3/1951 Muller-Munk
D167,619 S 9/1952 Coran
2,661,012 A 12/1953 Militano
2,745,421 A 5/1956 Russell
2,762,383 A 9/1956 Wittman
2,937,653 A 5/1960 Danciart et al.
D190,597 S 6/1961 Nelson
3,120,238 A 2/1964 Glatz
3,142,307 A 7/1964 Danciart et al.
3,145,720 A 8/1964 Torii
3,177,882 A 4/1965 Militano
3,177,883 A 4/1965 Militano
3,395,717 A 8/1968 Weber
3,424,180 A 1/1969 Giancarlo
3,457,931 A 7/1969 Yoshio
D221,039 S 6/1971 Zimmerman
3,802,452 A 4/1974 Weber
3,856,032 A 12/1974 Schafer
D234,729 S 4/1975 Weber et al.
D265,498 S 7/1982 Paul
4,368,749 A 1/1983 Lindler et al.
D276,838 S 12/1984 Hill et al.
4,586,525 A 5/1986 Glatz et al.
4,622,987 A 11/1986 Redl et al.
4,674,523 A 6/1987 Glatz
4,811,670 A 3/1989 Kolvites et al.
4,878,509 A 11/1989 Tung
4,993,445 A 2/1991 Dubinsky
5,002,081 A 3/1991 Stromeyer
5,020,557 A 6/1991 Apple
5,029,596 A 7/1991 Tung
5,050,627 A 9/1991 Hengtzu
5,174,319 A 12/1992 Chou et al.
5,284,171 A 2/1994 Liu
D344,786 S 3/1994 Short et al.
5,349,975 A 9/1994 Valdner
5,355,903 A 10/1994 Haddad et al.
5,357,994 A 10/1994 Chung
5,499,644 A 3/1996 Geniele
D372,854 S 8/1996 Jimenez
5,584,564 A 12/1996 Phyle
5,588,455 A 12/1996 Kuo
5,611,364 A 3/1997 Woods et al.
5,615,698 A 4/1997 Ko
5,640,984 A 6/1997 Dubunsky
5,655,557 A 8/1997 Martin
5,740,823 A 4/1998 Lin et al.
5,740,824 A 4/1998 Tang
5,749,386 A 5/1998 Samuel, Jr.
5,785,069 A 7/1998 Glatz
D397,054 S 8/1998 Brantley et al.
D398,443 S 9/1998 Bolle
5,809,734 A 9/1998 Turner
5,816,276 A 10/1998 Seidel et al.
D400,777 S 11/1998 Carsello
5,836,328 A 11/1998 Lee
5,871,024 A 2/1999 Vanderminden, Sr.
5,884,645 A 3/1999 Chen et al.
D408,621 S 4/1999 Kuo
5,899,210 A 5/1999 Letherby et al.
D410,862 S 6/1999 Milhov
5,937,882 A 8/1999 Harbaugh
6,014,980 A 1/2000 Glatz
D424,799 S 5/2000 Lai
D434,215 S 11/2000 Lin
D434,476 S 11/2000 Meda
6,145,523 A 11/2000 Lo
6,152,156 A 11/2000 Tung
D434,556 S 12/2000 Lin
6,192,907 B1 2/2001 Wu
6,220,261 B1 4/2001 Glatz
6,230,728 B1 5/2001 Reese
6,247,483 B1 6/2001 Rung
6,305,394 B1 10/2001 Reese
6,311,705 B1 11/2001 Ma
6,311,707 B1 11/2001 Wu et al.
6,314,976 B1 11/2001 Clarke
6,371,141 B1 4/2002 Lin et al.
6,371,686 B1 4/2002 Wu
6,374,840 B1 4/2002 Ma
6,386,214 B1 5/2002 Clarke
6,386,215 B1 5/2002 Chang
6,412,506 B1 7/2002 Reese
6,422,251 B1 7/2002 Tseng
6,446,650 B1 9/2002 Ma
6,478,037 B2 11/2002 Tung
6,571,813 B2 6/2003 Lin et al.
6,575,182 B2 6/2003 Tung
6,575,183 B2 6/2003 Tung
D477,458 S 7/2003 Goldwitz
6,588,438 B1 7/2003 Steiner
D478,416 S 8/2003 Clarke
6,619,306 B2 9/2003 Ma
6,662,815 B2 12/2003 Tung
D484,680 S 1/2004 You
D489,169 S 5/2004 You
D489,170 S 5/2004 You
6,732,753 B2 5/2004 Chang
6,758,229 B2 7/2004 Wang
D497,478 S 10/2004 Clarke
D497,479 S 10/2004 Yu
6,810,895 B2 11/2004 Lin et al.
6,837,255 B2 1/2005 Bunch et al.
6,848,459 B2 2/2005 Ma
6,851,823 B2 2/2005 Bilotti
D503,035 S 3/2005 Ko
6,889,699 B2 5/2005 Clarke
6,920,887 B2 7/2005 Lo
6,941,960 B2 9/2005 Huang
D515,803 S 2/2006 You
7,000,624 B2 2/2006 Chang
D525,721 S 7/2006 Landes
7,082,953 B2 8/2006 Liu
7,089,950 B2 8/2006 Lin
D539,632 S 4/2007 Ma
7,255,118 B2 8/2007 Ma
7,281,542 B2 10/2007 Ko
D555,349 S 11/2007 You
7,293,573 B2 11/2007 Clarke
D558,444 S 1/2008 Ma
7,318,444 B2 1/2008 Clakre
7,328,715 B2 2/2008 Neubardt
7,412,985 B2 8/2008 Ma
D586,549 S 2/2009 Hermanson et al.
D586,550 S 2/2009 Hermanson et al.
D587,448 S 3/2009 You
7,546,845 B2 6/2009 Prusmack
D600,439 S 9/2009 Zonsius
7,600,734 B2 10/2009 Clarke
7,665,477 B1 2/2010 Hathaway
7,686,024 B1 3/2010 Lai
7,703,464 B2 4/2010 Ma
7,775,226 B2 8/2010 MacDonald et al.
7,806,130 B2 10/2010 Gobel
D631,243 S 1/2011 Forthuber et al.
7,861,734 B2 1/2011 Ma
7,891,367 B2 2/2011 Ma
7,900,643 B2 3/2011 Ma
7,913,708 B2 3/2011 Yung
7,913,709 B2 3/2011 Brebner
D637,388 S 5/2011 You
D640,464 S 6/2011 Forthuber et al.
7,980,262 B1 7/2011 You
8,020,572 B2 9/2011 Ma
8,061,375 B2 11/2011 Ma
D650,984 S 12/2011 Pineda

(56) References Cited

U.S. PATENT DOCUMENTS

| | | | |
|---|---|---|---|
| 8,082,935 | B2 | 12/2011 | Ma |
| 8,096,310 | B2 | 1/2012 | Clarke |
| D664,760 | S | 8/2012 | Elder |
| 8,272,391 | B2 | 9/2012 | Luo |
| 8,443,819 | B2 | 5/2013 | Beaulieu |
| D731,166 | S | 6/2015 | Ma |
| 9,113,683 | B2 | 8/2015 | Ma |
| D759,955 | S | 6/2016 | Ma |
| D759,956 | S | 6/2016 | McQuaid |
| 9,504,298 | B2 | 11/2016 | Li |
| D818,697 | S | 5/2018 | Ma |
| 10,758,015 | B2 | 9/2020 | Ma |
| 11,206,903 | B2 | 12/2021 | Ma |
| 2002/0083969 | A1 | 7/2002 | Tung |
| 2002/0139405 | A1 | 10/2002 | Lee |
| 2003/0010367 | A1 | 1/2003 | Ko |
| 2003/0015230 | A1 | 1/2003 | Glatz |
| 2003/0062073 | A1 | 4/2003 | Tung |
| 2004/0031513 | A1 | 2/2004 | Bunch et al. |
| 2004/0055627 | A1 | 3/2004 | P. Moga |
| 2004/0055628 | A1 | 3/2004 | Yu |
| 2004/0069333 | A1 | 4/2004 | Ma |
| 2004/0154525 | A1 | 8/2004 | Wirth et al. |
| 2004/0182429 | A1 | 9/2004 | Chen |
| 2004/0206382 | A1 | 10/2004 | Clarke |
| 2004/0206383 | A1 | 10/2004 | Clarke |
| 2005/0081902 | A1 | 4/2005 | Liu |
| 2005/0098200 | A1 | 5/2005 | Su |
| 2006/0005867 | A1 | 1/2006 | Chang |
| 2006/0151019 | A1 | 7/2006 | Lo |
| 2007/0113878 | A1 | 5/2007 | Ko |
| 2008/0041433 | A1 | 2/2008 | Caldwell |
| 2008/0202570 | A1 | 8/2008 | Clarke |
| 2009/0126769 | A1 | 5/2009 | Hoogendoorn |
| 2010/0139724 | A1 | 6/2010 | Lai |
| 2010/0139725 | A1 | 6/2010 | Lai |
| 2011/0061694 | A1 | 3/2011 | Vanderminden, Sr. |
| 2011/0132418 | A1 | 6/2011 | Ma |
| 2011/0209732 | A1 | 9/2011 | Ma |
| 2011/0214705 | A1 | 9/2011 | Ma |
| 2011/0277800 | A1 | 11/2011 | Tung |
| 2014/0109942 | A1 | 4/2014 | Ma |
| 2014/0305476 | A1 | 10/2014 | Ma |
| 2015/0237976 | A1 | 8/2015 | Chow |
| 2020/0297085 | A1 | 9/2020 | Ma |

FOREIGN PATENT DOCUMENTS

| | | | |
|---|---|---|---|
| CN | 2579212 | | 10/2003 |
| CN | 202190859 | | 4/2012 |
| CN | 202588579 | | 12/2012 |
| CN | 210581325 | | 5/2020 |
| DE | 22 04 217 | | 8/1973 |
| DE | 24 34 495 | | 2/1975 |
| DE | 3820573 | | 8/1989 |
| DE | 202010011240 | | 11/2010 |
| DE | 202012007364 | | 11/2012 |
| DE | 202017002887 | | 7/2017 |
| DE | 202019103816 | | 7/2019 |
| EP | 0 628 264 | | 12/1994 |
| EP | 1 510 145 | | 3/2005 |
| FR | 2672781 | A3 | 8/1992 |
| JP | 58-107024 | | 7/1983 |
| JP | H08-322621 | | 12/1996 |
| JP | 2000-139533 | | 5/2000 |
| JP | 2001-046131 | | 2/2001 |
| JP | 2006-110317 | A | 4/2006 |
| JP | 2007-222591 | | 9/2007 |
| JP | 2008-142310 | | 6/2008 |
| JP | 3144314 | | 7/2008 |
| JP | 2009-045359 | | 3/2009 |
| JP | 2009-247750 | | 10/2009 |
| WO | WO 2005/058089 | | 6/2005 |
| WO | WO 2007/092514 | | 8/2007 |

TILTABLE UMBRELLA WITH REMOVABLE GUIDE TRACK

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 C.F.R. § 1.57.

BACKGROUND OF THE INVENTION

Field of the Invention

This application is directed to a device to tilt an upper portion of an umbrella relative to a lower portion.

Description of the Related Art

Patio umbrellas are well known. Among patio umbrellas, some designs allow the location of shade cast thereby to be altered by tilting an upper part of the umbrella relative to a lower part of a pole that supports the upper part of the umbrella.

Because umbrellas can be heavy and it is desired that they last a long time, a common practice has been to inner core mold some of the components at which the tilting occurs. This process is able to create a series of channels through the molded components that are needed for actuating the tilting action and for passing a cord for raising and lowering the umbrella canopy. However, this process limits the ability to form tight clearances and to make very smooth internal surfaces and edges. It is possible to using stripping and burr trimming processes after molding to improve the parts formed thereby, but when these processes are adapted to tilt umbrella components, the process takes longer than desired.

If these processes are incomplete, the burrs and other irregularities can result in the cord being damaged or even cut. Re-threading a cord in a tilt umbrella of this type is very difficult, resulting in time-consuming re-work or excess scrap components.

SUMMARY OF THE INVENTION

It would be useful to improve the design and performance of tilting umbrellas. It would be beneficial to provide components for a tilt umbrella that allow access to pathways through which cords and other control devices move. Such access during manufacturing and repair would increase the lifespan and performance of umbrellas with components having such access.

In one embodiment, a tilt device for an umbrella is provided that includes a first tilt member and a second tilt member. The second tilt member is pivotably coupled with the first tilt member. The tilt device also includes a guide track assembly disposed in the first tilt member. The guide track assembly has a first guide track member and a second guide track member. The first guide track member has a first guide track portion disposed in a side portion thereof. The second guide track member has a second guide track portion disposed in a side portion thereof. The first guide track member and the second guide track member are separate members that are configured to mate at the side portions thereof to join the second guide track portion to the first guide track portion to form an enclosed guide track. The tilt device also includes a driver that has an upper portion disposed in the second tilt member and a lower portion. The lower portion is disposed in the enclosed guide track. The enclosed guide track is configured to guide movement of the lower portion of the driver within the first tilt member. Movement of the driver causes the second tilt member to tilt relative to the first tilt member.

In another embodiment an umbrella is provided. The umbrella includes a canopy assembly, a first pole section and a second pole section disposed between the first pole section and the canopy assembly. The umbrella also includes a guide track assembly and a driver. The guide track assembly is disposed in the first pole section. The guide track assembly has a first member and a second member. The first member and the second member are separate members configured to mate at respective side portions. An enclosed guide track is disposed within the guide track assembly. The drive has an upper portion disposed in the second pole section and a lower portion configured to be guided by the enclosed guide track. Movement of the driver tilts the second pole section relative to the first pole section.

In another embodiment an umbrella is provided that includes a canopy assembly, a first pole section and a second pole section disposed between the first pole section and the canopy assembly. The umbrella includes a cord guide member. The cord guide member is removably disposed in the first pole section. The cord guide member has an elongate concave surface disposed on an outside surface thereof. The elongate concave surface faces away from a central longitudinal axis of the first pole section when the cord guide member is disposed in the first pole section. The second pole section is tiltable relative to the first pole section.

In some variations, the umbrella or tilt device includes a driver. The driver can have an upper portion disposed in the second pole section and a lower portion configured to be guided within the first pole section between a position corresponding to the umbrella being straight and a position corresponding to being tilted relative to the first pole section or the first tilt member.

BRIEF DESCRIPTION OF THE DRAWINGS

These and other features, aspects and advantages are described below with reference to the drawings, which are intended to illustrate but not to limit the inventions. In the drawings, like reference characters denote corresponding features consistently throughout similar embodiments. The following is a brief description of each of the drawings.

DETAILED DESCRIPTION OF THE PREFERRED EMBODIMENT

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein. Each and every feature described herein, and each and every combination of two or more of such features, is included within the scope of the present invention provided that the features included in such a combination are not mutually inconsistent.

Figure 1:
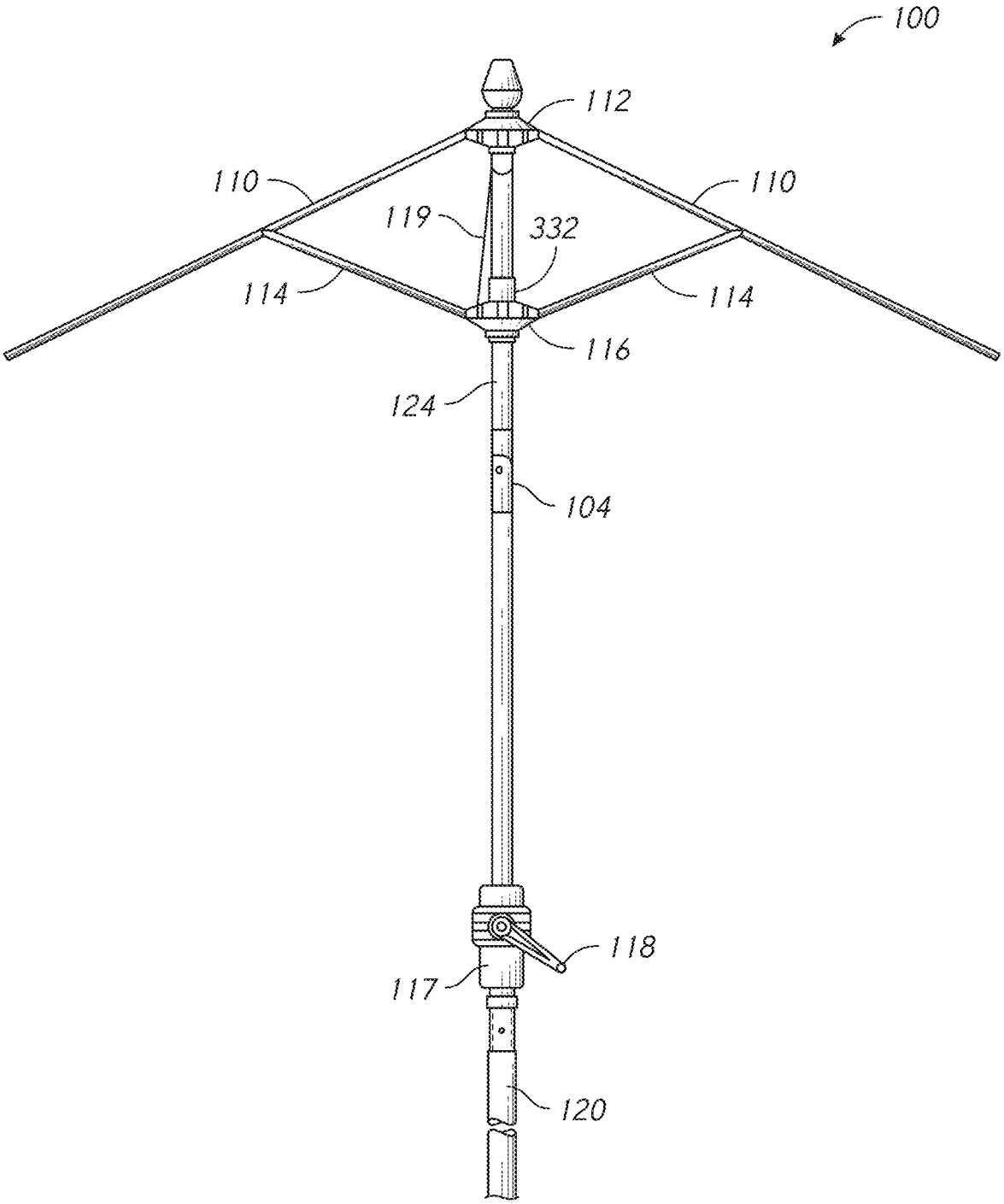
FIG. 1 is a side view of an umbrella frame of an umbrella that that can be opened in an upright configuration.
Figure 2:
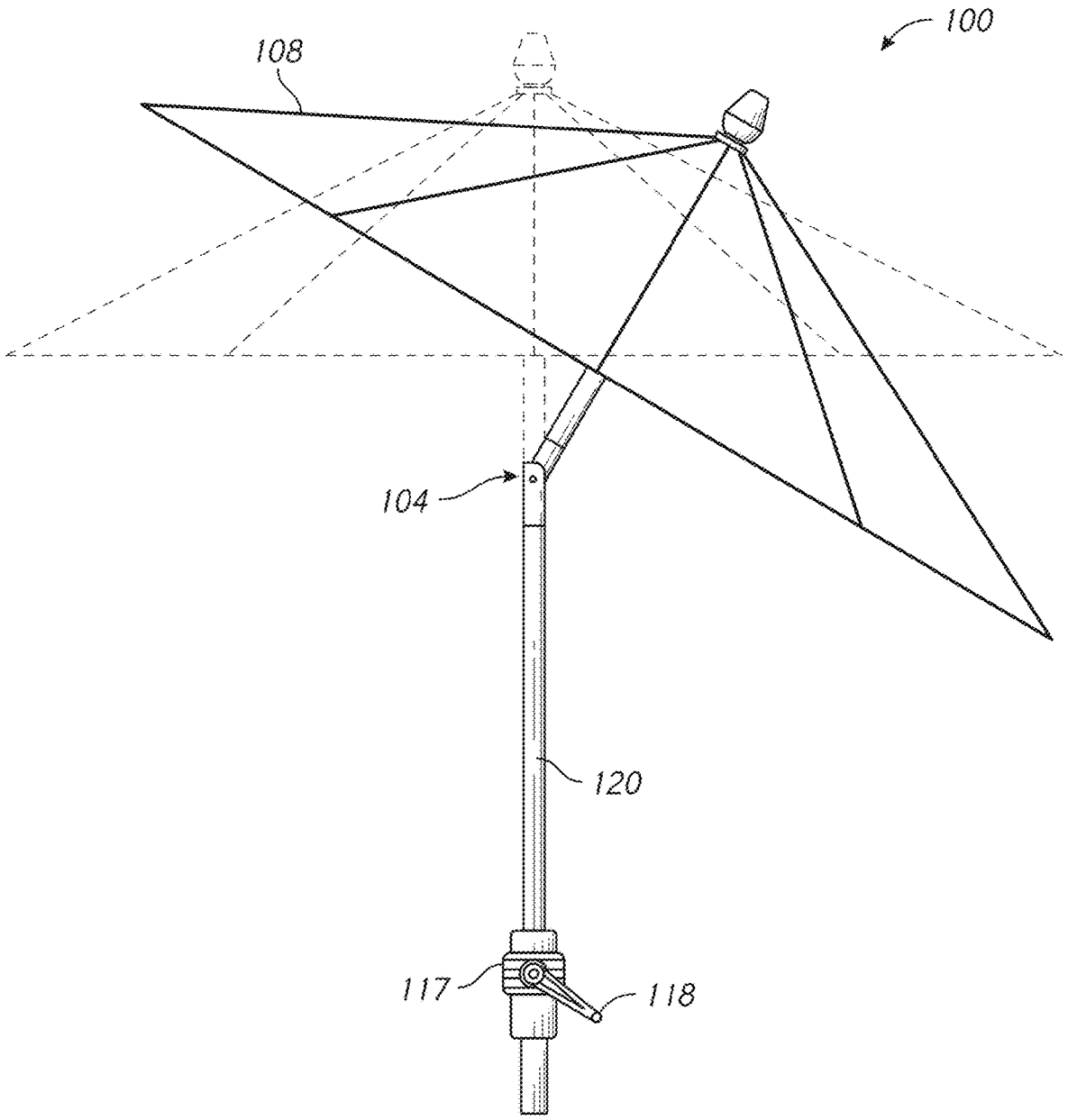
FIG. 2 is side view showing that the umbrella of FIG. 1 can be tilted from the upright position of FIG. 1 to a tilted position to provide better shade late when the sun is low in the sky.

FIG. 1 shows one embodiment of an umbrella 100 with a tilt device 104 that enables a canopy assembly 108 (shown schematically in FIG. 2) coupled with a top portion of the umbrella 100 to be moved as discussed herein to move the shade provided thereby. The umbrella 100 also includes a first pole section 120 and a second pole section 124. The second pole section 124 can be described as an upper pole section. The first pole section 120 can be described as a lower pole section. The second pole section 124 is disposed between the tilt device 104 and at least a portion of the canopy assembly 108. The canopy assembly 108 includes a number of ribs 110 that are supported at one end by a central hub or top notch 112 and that are supported at a middle section by struts 114. The struts 114 are pivotably coupled with the ribs 110 at one end thereof and at a lower hub or runner 116 at an opposite end thereof. The canopy assembly 108 includes a fabric that is disposed over, e.g., stretched over, the ribs 110 particularly in the open configuration as shown in FIGS. 1 and 2.

The runner 116 can be raised or lowered by any means, including a winch 117. The winch 117 can include a crank 118 coupled with a cord 119. By rotating the crank 118, the cord 119 can be wound in our out. When wound in, the runner 116 will be raised. When wound out, the runner 116 will be lowered.

The first pole section 120 can extend from a bottom portion of the umbrella 100 to the tilt device 104. The winch 117 can be mounted to the first pole section 120. A length of the cord 119 can extend through the first pole section 120 from the winch 117 the tilt device 104. The cord 119 can be routed through the tilt device 104 in a manner that protects the cord 119 during the tilting of the tilt device 104 as discussed further below. The cord 119 can further extend to the second pole section 124. The cord 119 can extend to a pulley disposed toward the top of the second pole section 124. The cord 119 can extend over the pulley and out of the second pole section 124 and thereafter down to the runner 116. The cord 119 can be mounted to a top or internal surface of the runner 116.

Figure 3A:
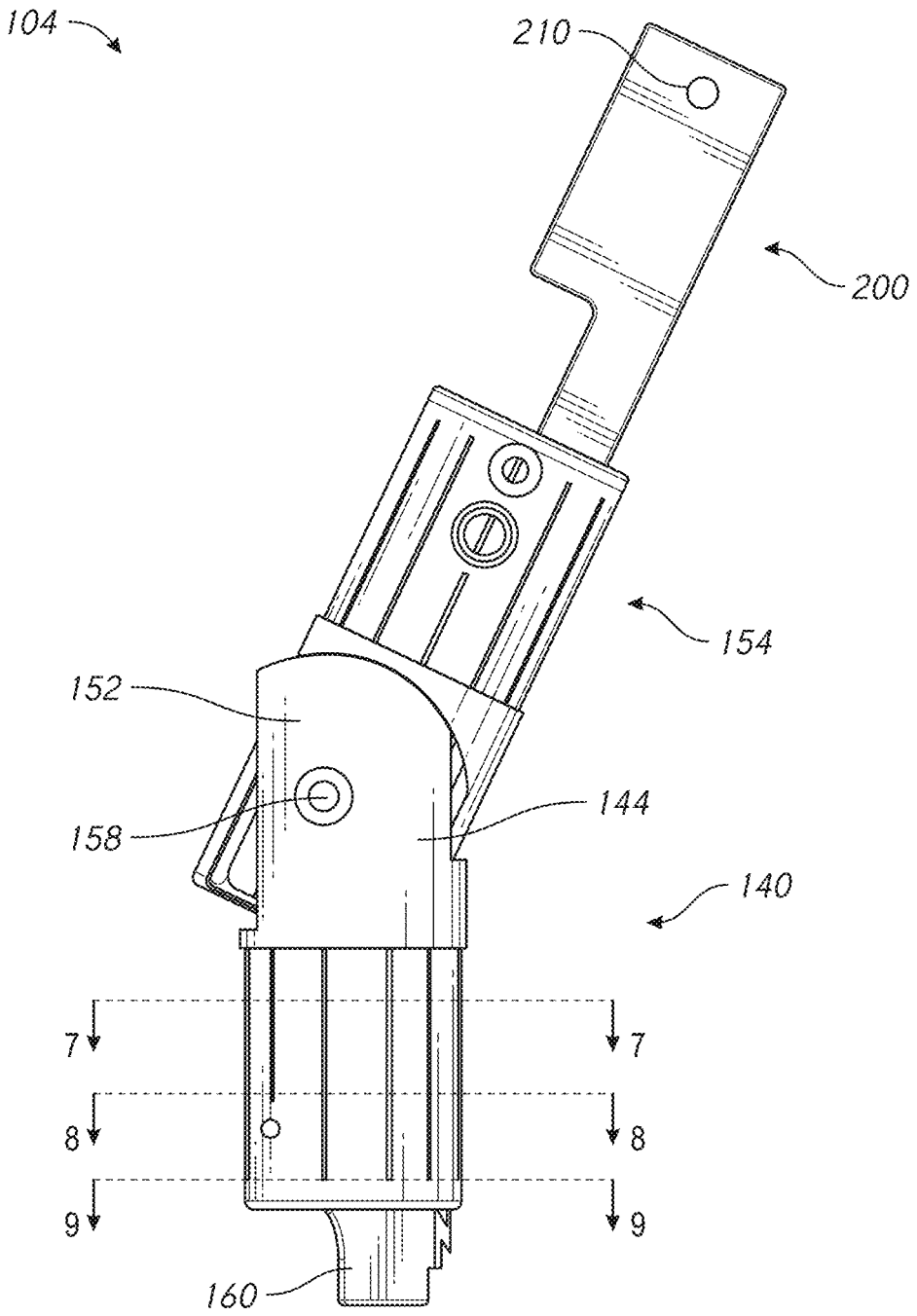
FIG. 3A is a side view of a tilt device that can be disposed in the umbrella of FIGS. 1-2, the tilt device in a configuration suitable for the solid line view of FIG. 2.
Figure 3B:
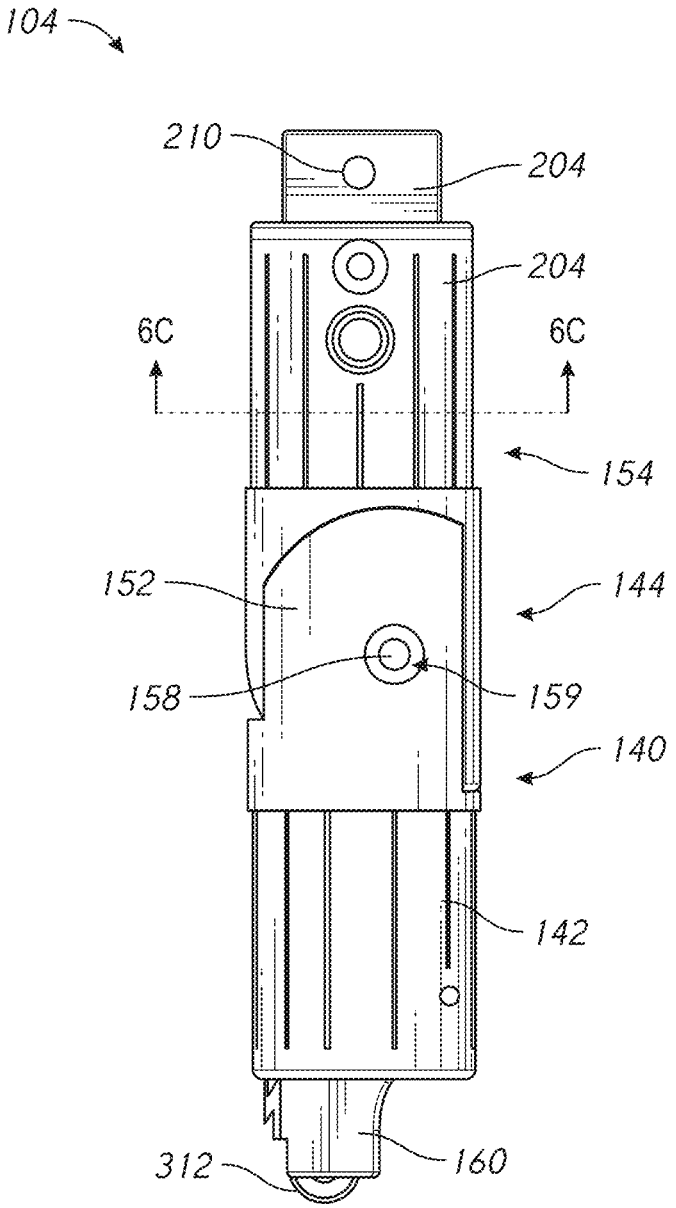
FIG. 3B is a side view of the tilt device of FIG. 3A disposed in a configuration suitable for the dashed line configuration of FIG. 2.

FIGS. 3A and 3B show that the tilt device 104 has two pivotable sections in one embodiment. The tilt device 104 includes a first tilt member 140 and a second tilt member 154 pivotably coupled with the first tilt member 140. In one embodiment a shaft 158 is provided that extends through an upper portion 144 of the first tilt member 140 and through a lower portion 155 (shown more clearly in FIG. 4) of the second tilt member 154. A joint section of the tilt device 104 is provided that includes the upper portion 144 of the first tilt member 140 and the lower portion 155 of the second tilt member 154. For example the first tilt member 140 can have a U-shaped structure 151 (see FIG. 4). The U-shaped structure 151 can have first and second lateral projections 152. FIGS. 3A-5B show that a lower portion 155 of the second tilt member 154 can be received within the u-shaped structure 151. The lower portion 155 can be disposed between the lateral projections 152 to pivot therebetween. Openings 159 formed in the lower portion 155 of the second tilt member 154 and in the upper portion 144 of the first tilt member 140 can be aligned and can receive the shaft 158 therethrough to enable the pivoting of the second tilt member 154 relative to the first tilt member 140.

The tilt device 104 is configured to be coupled with the first pole section 120 and to the second pole section 124. For example, the lower portion 142 of the first tilt member 140 can be configured to be inserted into the first pole section 120. The upper end of the first pole section 120 can be advanced into engagement with a small step between the upper portion 144 and the lower portion 142 of the first tilt member 140. The lower portion 142 can have an outside diameter that is less than the inside diameter of the first pole section 120. A rivet or other connector can join the lower portion 142 to the first pole section 120. The upper portion 156 of the second tilt member 154 can be configured to be inserted into the second pole section 124. The lower end of the second pole section 124 can be advanced over the upper portion 156 of the second tilt member 154 until the lower end comes into contact with a small step between the upper portion 156 and the lower portion 155 of the second tilt member 154. The upper portion 156 can have a smaller outside diameter than the inside diameter of the second pole section 124 such that the upper portion 156 can be inserted into the second pole section 124. A rivet or other connector can join the upper portion 156 to the second pole section 124.

Figure 4:
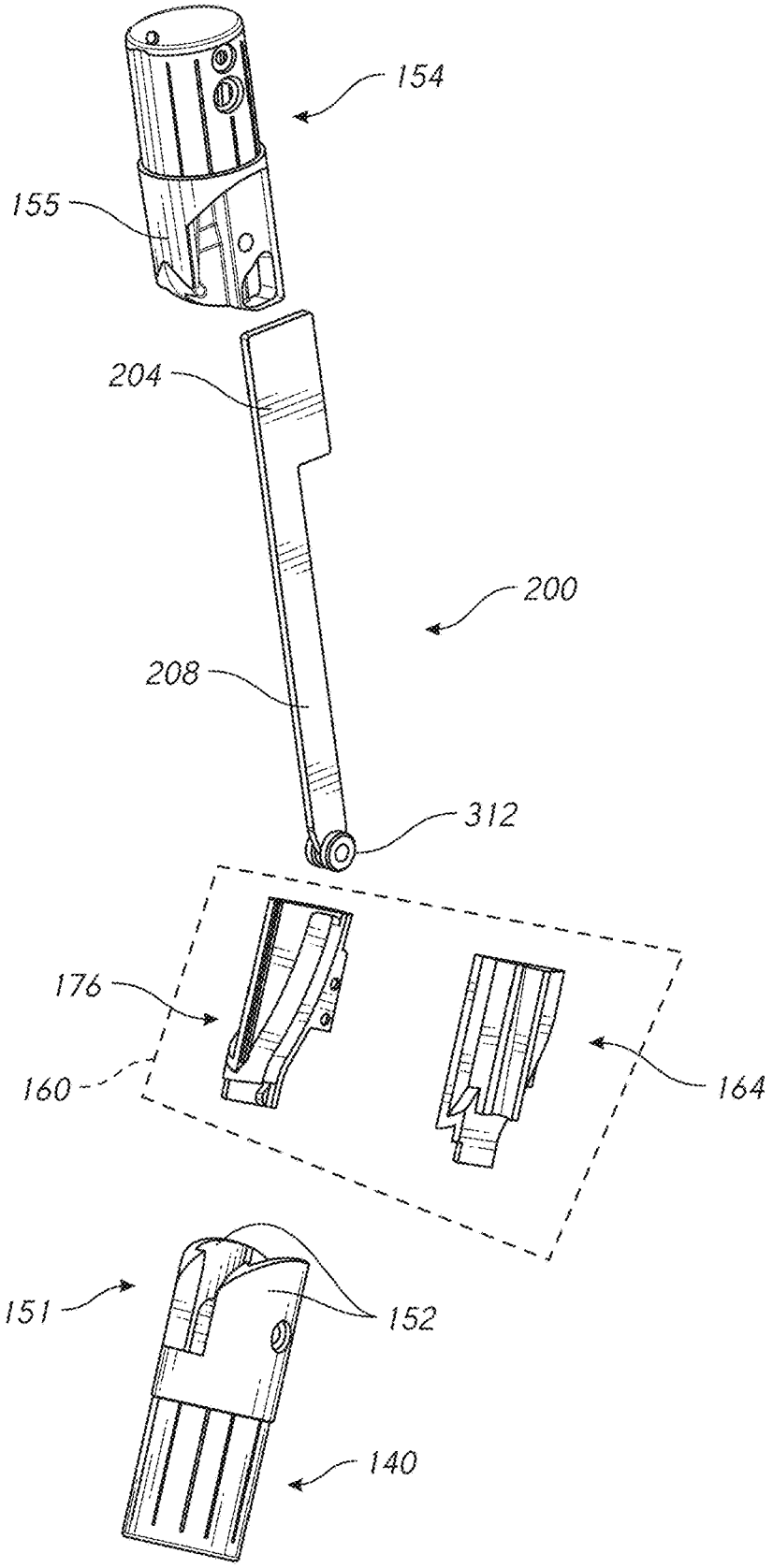
FIG. 4 is an exploded view of the tilt device of FIG. 3A.

The pivoting of the second tilt member 154 relative to the first tilt member 140 can be provided in a controlled manner by providing a guide track assembly 160 and a driver 200. The guide track assembly 160 is an example of a guide body that can be removably disposed within the first tilt member 140. Preferably the guide track assembly 160 is separate from but configured to be received in the first tilt member 140. FIG. 4 shows that the guide track assembly 160 includes a first guide track member 164 and a second guide track member 176. The first guide track member 164 and the second guide track member 176 are separate members. The first guide track member 164 and the second guide track member 176 are joined during assembly and then inserted into the first tilt member 140.

Figure 11:
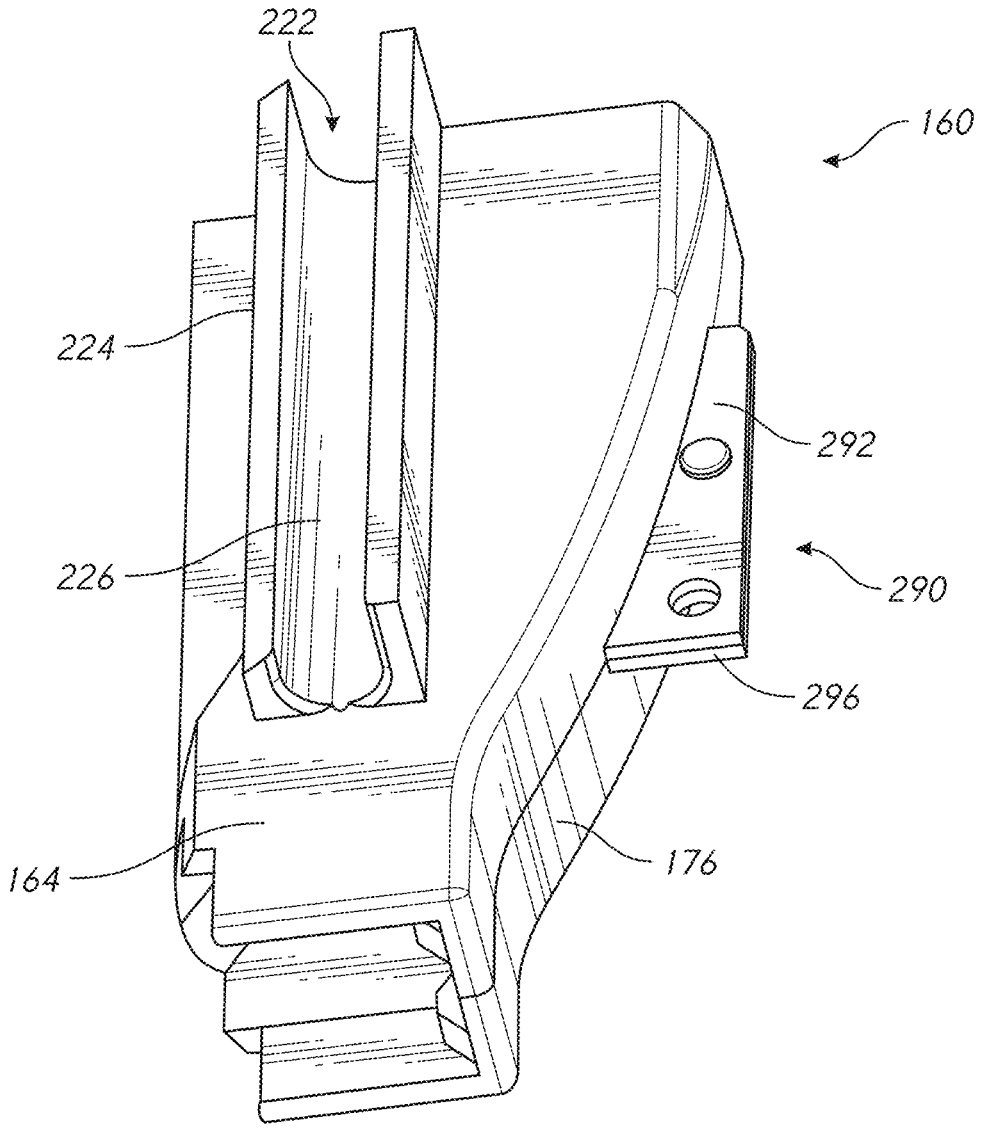
FIG. 11 is a bottom perspective view of a guide track assembly according to one embodiment herein.
Figure 12:
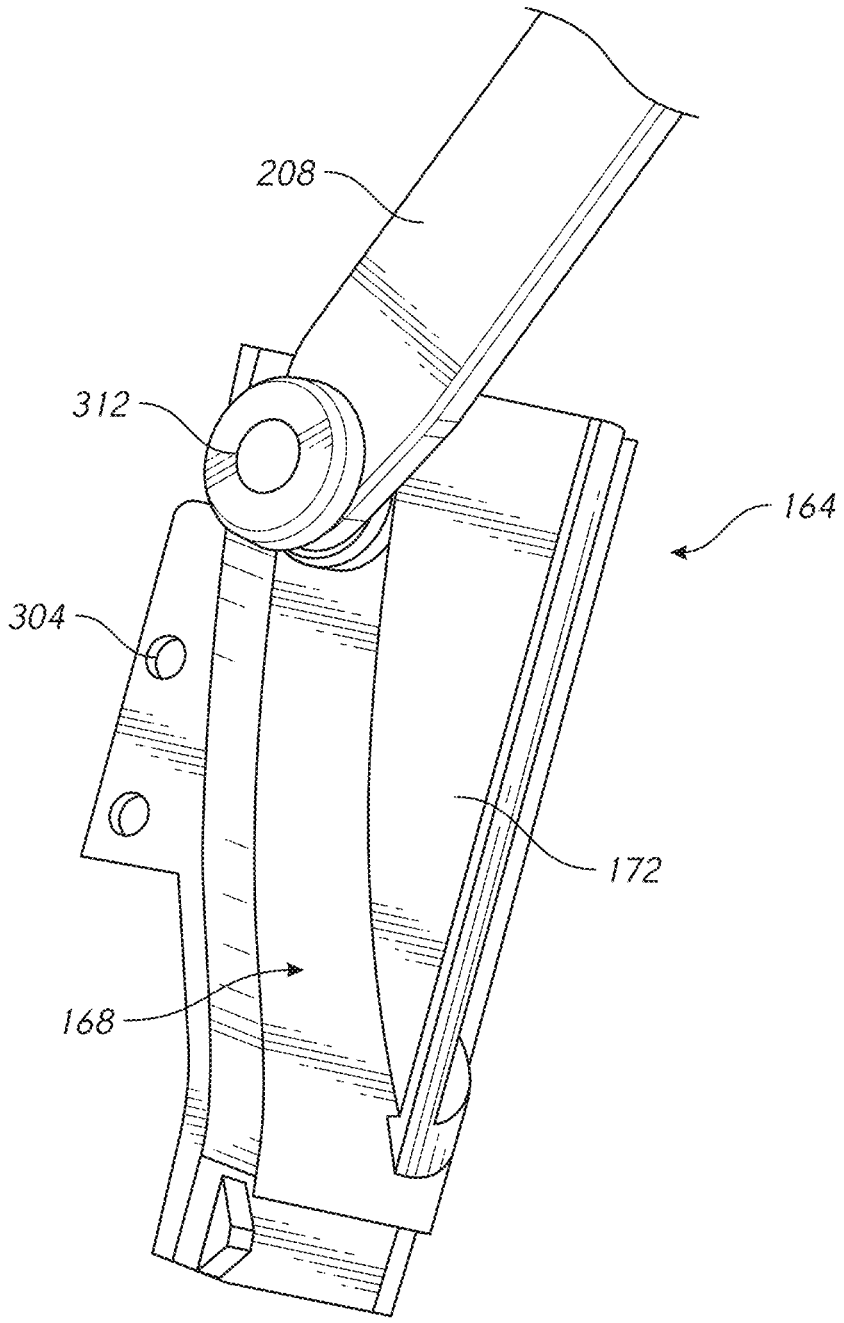
FIGS. 12-13 are perspective and side views of a first guide track member of a guide track assembly with a driver disposed in a guide track portion.

The guide track assembly 160 has an enclosed guide track 188 disposed therein. The enclosed guide track 188 is one example of a guide track disposed in or on a guide body, e.g., in the guide track assembly 160 that is removably disposed in the first tilt member 140. In one embodiment, the first guide track member 164 has a first guide track portion 168 formed in a side portion 172 thereof. In one embodiment, the second guide track member 176 includes a second guide track portion 180 disposed in a side portion 184 thereof. FIG. 11 shows that the first guide track member 164 and the second guide track member 176 are configured to mate to each other such that the first guide track portion 168 and the second guide track portion 180 join together to form a complete enclosed guide track 188. In the illustrated embodiment, the enclosed guide track 188 is partly formed in each of the first guide track member 164 and the second guide track member 176, e.g., one-half portions in each. The first guide track member 164 and the second guide track member 176 can mate by connecting the side portion 172 to the side portion 184. The mating can be further enhanced by an opening 304 formed in a first flange portion 292 of the first guide track member 164 and a peg 300 formed in a second flange portion 296 of the second guide track member 176 as discussed further below.

Figure 14:
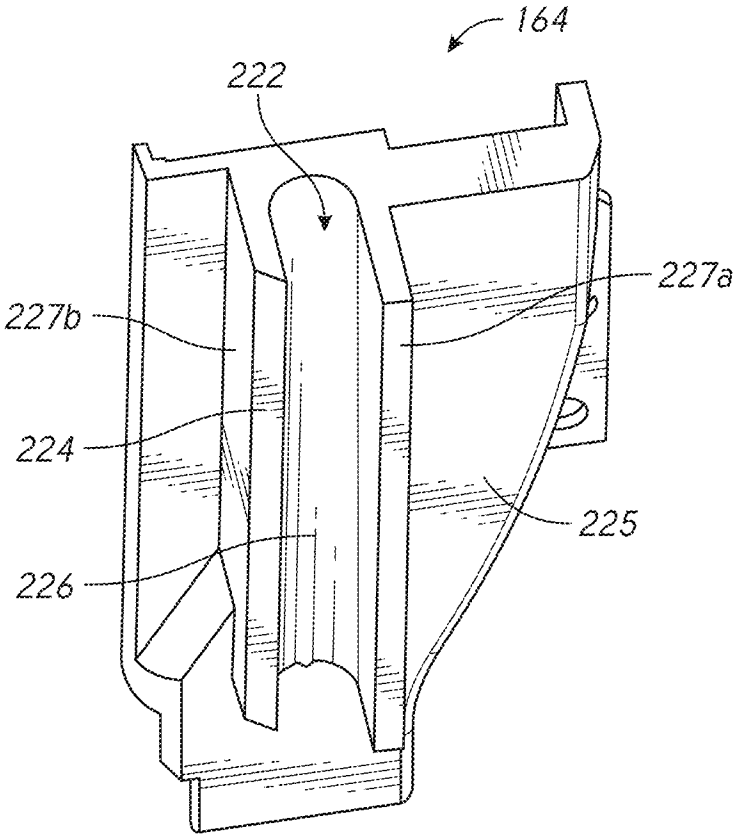
FIG. 14 is a side perspective view of the first guide track member, showing a cord path on a side of the first guide track member opposite the side shown in FIGS. 12-13.
Figure 13:
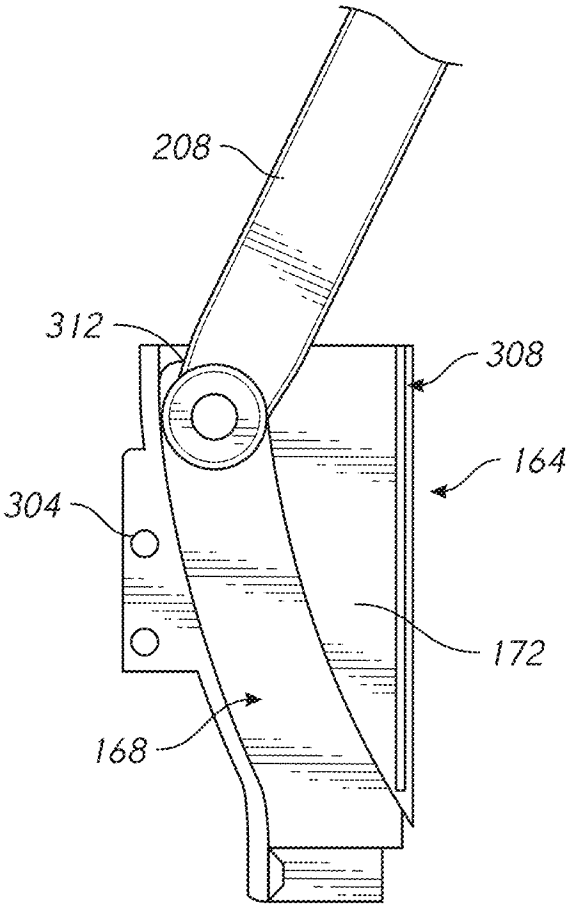
Figure 15:
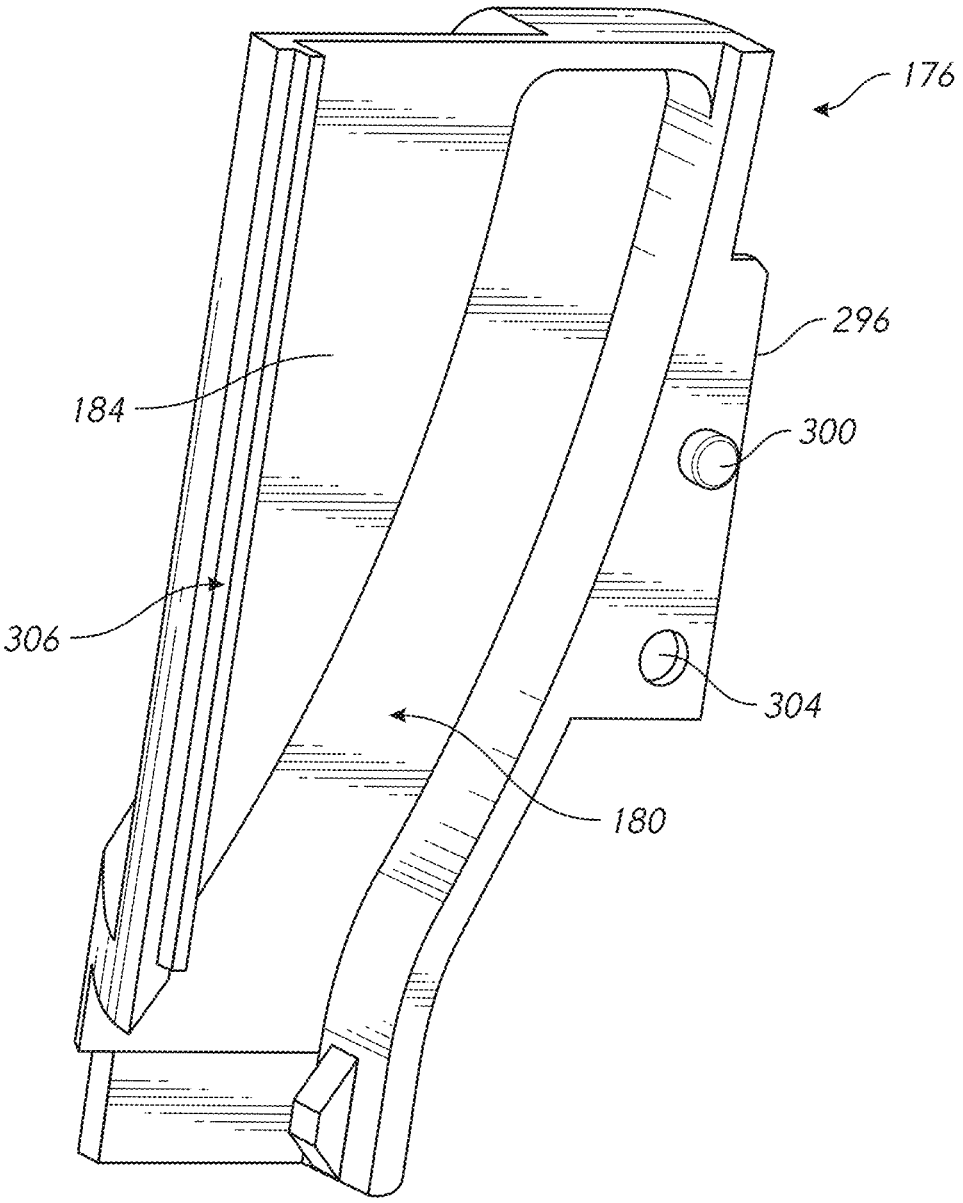
FIGS. 15-16 are perspective and side views of a second guide track member of a guide track assembly.
Figure 17:
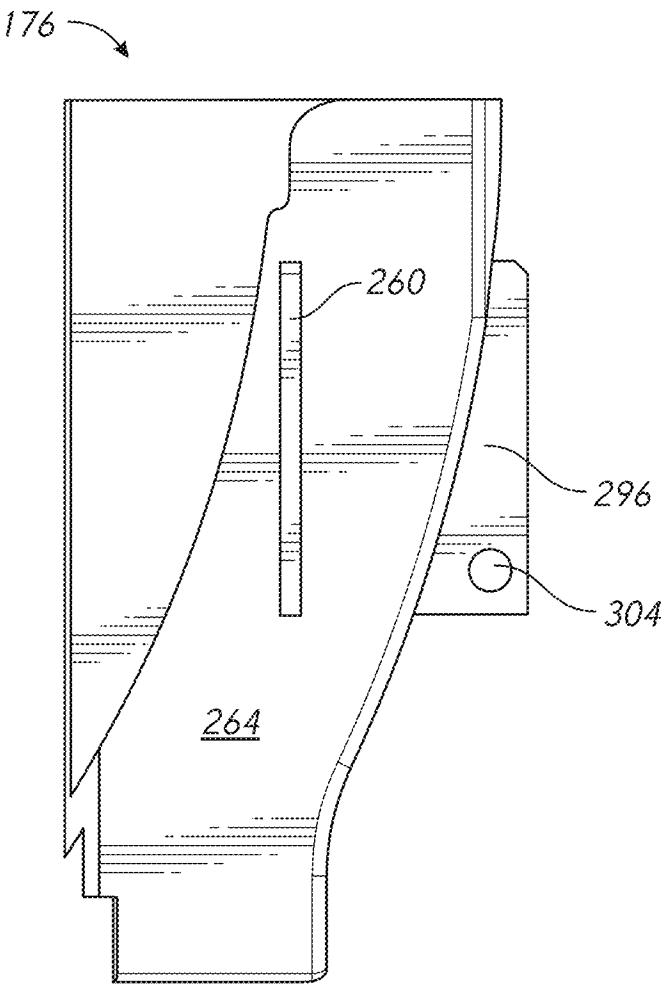
FIG. 17 is a side view of the second guide track member, showing coupling flange structures disposed on a side of the second guide track member opposite the side shown in FIGS. 15-16.
Figure 16:
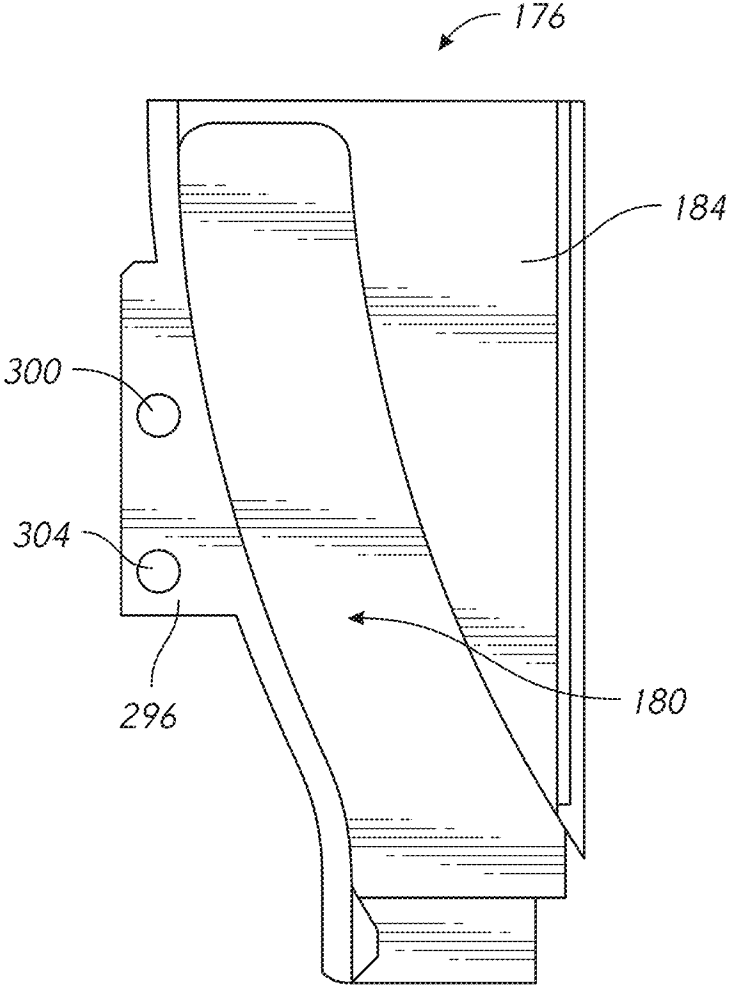

FIGS. 13-15 show that in some embodiments the guide track assembly 160 can be joined at one lateral side by mating ridges. FIG. 15 shows that the second guide track member 176 can have an elongate ridge 306 disposed along vertical length there. FIG. 13 shows that the first guide track member 164 can have an elongate ridge 308 along a corresponding vertical length thereof. The elongate ridge 306 and the elongate ridge 308 are configured to mate when side portions of the first guide track member 164 and second guide track member 176 are joined. The elongate ridge 308 extends at least partially over the elongate ridge 306. As a result, a seam between the ridges 306, 308 is offset from the midline of the enclosed guide track 188. This allows the driver 200 to slide along an inner surface of the second guide track member 176 without contacting the seam. As a result, the driver 200 is prevented from pressing into the same which could otherwise tend to cause a gap to open between the first guide track member 164 and the second guide track member 176.

Figure 7:
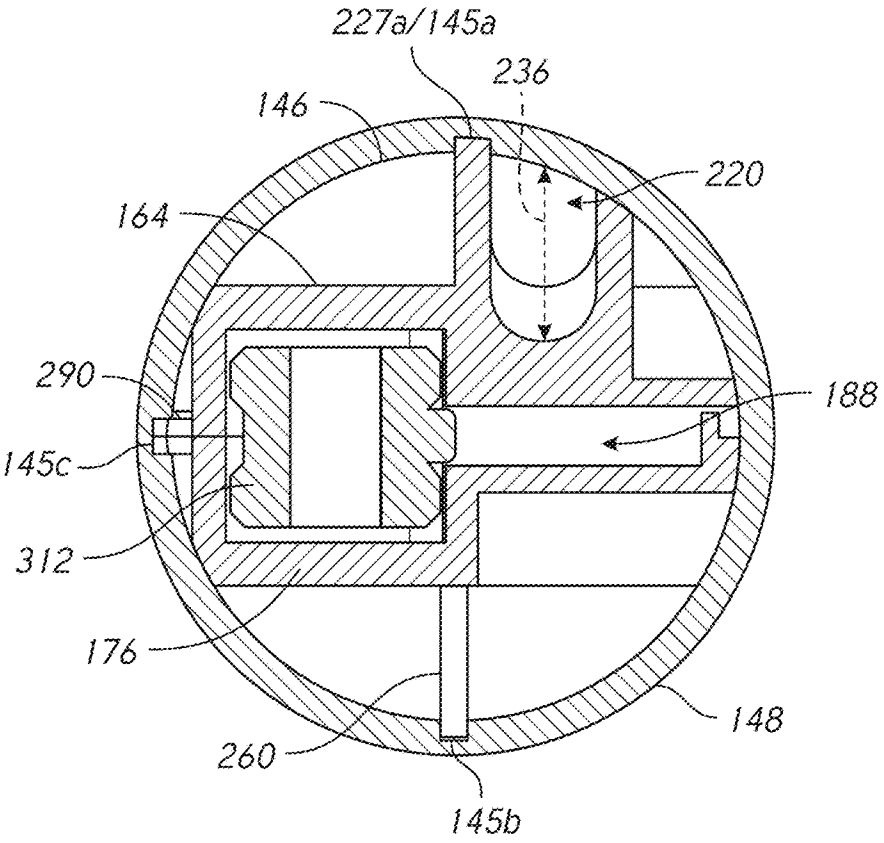
FIG. 7 is a cross-sectional view of the tilt assembly of FIG. 2 taken at section plane 7-7 shown in FIG. 3A.
Figure 10:
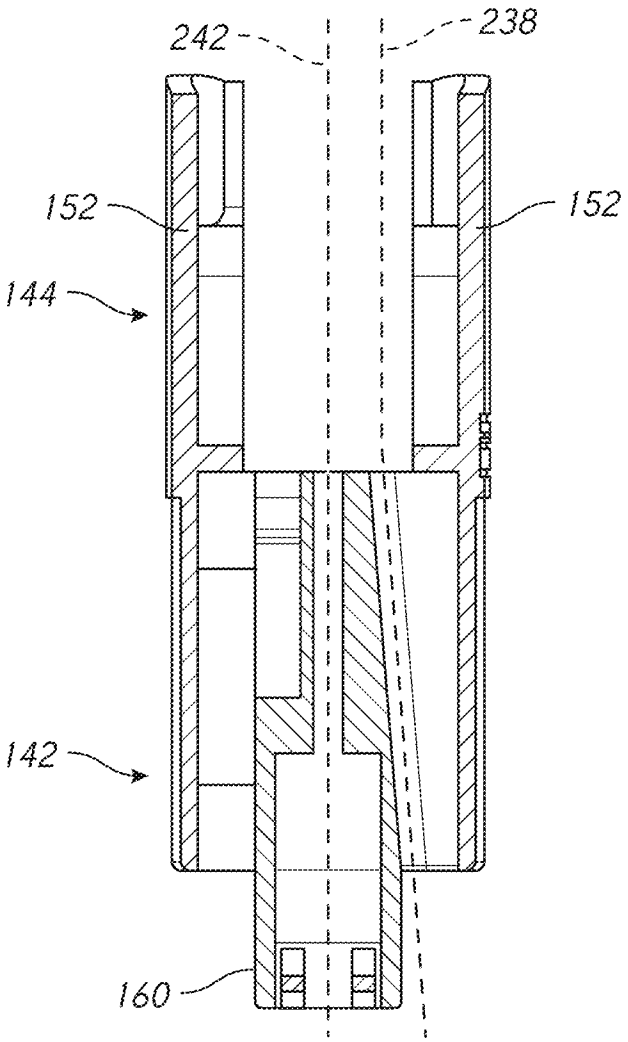
FIG. 10 is a cross-section view of a lower tilt member and a guide track assembly showing a cord channel portion disposed through the lower tilt member.

FIG. 4 is an exploded view of the tilt device 104 that shows the driver 200 as well as the first tilt member 140 and the second tilt member 154 in which the driver 200 is disposed and in which the driver 200 moves. The driver 200 includes an upper portion 204 and a lower portion 208. The upper portion 204 is configured to be disposed in the second tilt member 154. The lower portion 208 is configured to be disposed in the first tilt member 140. In one embodiment, the lower portion 208 is an elongate member that is narrower (e.g., in a direction transverse to the longitudinal axis of the driver 200) than the upper portion 204. The lower portion 208 can be sufficiently elongated to also extend into the second tilt member 154. FIGS. 4 and 7 show that the lower portion 208 can have one or a plurality of rollers 312 that can be disposed in the enclosed guide track 188. The rollers 312 can actually be configured to roll within the enclosed guide track 188 or can be configured as a low friction material that slides within the enclosed guide track 188.

FIGS. 3A and 3B shows two positions of the upper portion 204 relative to the upper portion 156 of the second tilt member 154. In FIG. 3B an uppermost edge of the upper portion 204 protrudes out of the upper portion 156 by a first amount. In this position a linking aperture 210 is located outside of the second tilt member 154. In FIG. 3A, the upper portion 204 of the driver 200 is at a second position relative to the upper portion 156 of the second tilt member 154. In this position the linking aperture 210 is farther extended outside of the upper portion 156 of the second tilt member 154. As discussed further below, the linking aperture 210 is coupled with a collar 332 that causes movement of the driver 200 and corresponding motion of the roller 312 within the enclosed guide track 188 from the position of FIG. 3B to the position of FIG. 3A. The top surface of the upper portion 204 can be engaged with an axial spring, which is not shown. More details of the axial spring are set forth in U.S. Pat. No. 6,446,650, which is hereby incorporated by reference herein for this purpose and in its entirety.

The tilt device 104 is configured to receive the cord 119 and to facilitate movement thereof through the umbrella 100. In one embodiment a cord channel 220 is provided through the tilt device 104. The cord channel 220 is defined in part by an open channel 222 in the guide track assembly 160. The open channel 222 is one example of a guide track disposed in or on a guide body, such as in or on the guide track assembly 160. The guide track assembly 160 can include a projection 224 disposed on a side surface 225 thereof. The projection 224 can be disposed on the side surface 225 of the first guide track member 164. The projection 224 can have a U-shape configuration. The projection 224 can include a concave surface 226 extending between opposing sections of the projection 224. The opposing sections of the projection 224 can extend different distances from the side surface 225. FIGS. 7-9 and 14 show that the projection 224 is configured to closely fit to an inner wall 146 of the lower portion 142 of the first tilt member 140. The first tilt member 140 can also include an outer wall 148 configured to receive the first pole section 120. The first pole section 120 can have an inner diameter allowing the first pole section 120 to be advanced over the outer wall 148. A first section 227*a* of the opposing sections can be positioned on the guide track assembly 160 such that when the guide track assembly 160 is received in the first tilt member 140 the first opposing section 227*a* is disposed on a diameter of the circular periphery of the lower portion 142 of the first tilt member 140. The first opposing section 227*a* can extend into an axial slot 145*a* of the lower portion 142 of the first tilt member 140. In one embodiment, the lower portion 142 includes a plurality of axial slots. For example, as shown in FIG. 9 a first axial slot 145*a* located at 12 o'clock is configured to receive the first opposing section 227*a*. A second axial slot 145*b* is disposed opposite the axial slot 145*a* that receives the first opposing section 227*a*. The second axial slot 145 is located at 6 o'clock in FIG. 9. A third axial slot 145*c* can be located at a portion of the inner wall 146 of the lower portion 142 of the first tilt member 140. The third axial slots 145*c* can be disposed at a 9 o'clock in FIG. 9. A fourth axial slot 145 (not shown) can be located at a portion of the inner wall 146 of the lower portion 142 of the first tilt member 140 opposite the third axial slot 145*c*. The fourth axial slot 145 can be disposed at a 3 o'clock in FIG. 9. Any of the axial slots 145 are optional and other structures for securing the guide track assembly 160 in the first tilt member 140 can be provided.

FIG. 9 shows that the second opposing section 227*b* can be configured to mate with the inner wall 146 of the lower portion 142 of the first tilt member 140. In the illustrated embodiment, the second opposing section 227*b* extends a lesser amount from the side surface 225 than does the first opposing section 227*a*. An end face of the second opposing section 227*b* can be curved to conform to a circular inner profile of the inner wall 146. The second opposing section 227*b* can form a portion of a convex profile of the guide track assembly 160 that is configured to be slideably received in and conform generally to the inner concave profile of the inner wall 146 of the lower portion 142 of the first tilt member 140.

FIGS. 9 and 11 shows that the open channel 222 can be disposed on the first guide track member 164. The open channel 222 can be located opposite the first guide track portion 168. The concave surface 226 can face away from the first guide track portion 168.

The open channel 222 can be accessible prior to the guide track assembly 160 being mounted in the first tilt member 140. The accessibility of the open channel 222 enables the concave surface 226 to be made very smooth to allow the cord 119 to have minimal wear in normal use, which can involve the cord 119 sliding over the concave surface 226. At least a portion of the concave surface 226 comprises a low friction, yet durable material. Example structures and materials for the concave surface 226 can include a smooth surface, a plastic surface, a soft plastic coating or a hard but smooth plastic structure. In one embodiment, the first guide track member 164 and the second guide track member 176 are formed of different materials. The first guide track member 164 can be entirely formed of the materials set forth above. In other embodiments, the side of the first guide track member 164 in which the projection 224 is formed can comprise the materials set forth above.

Figure 8:
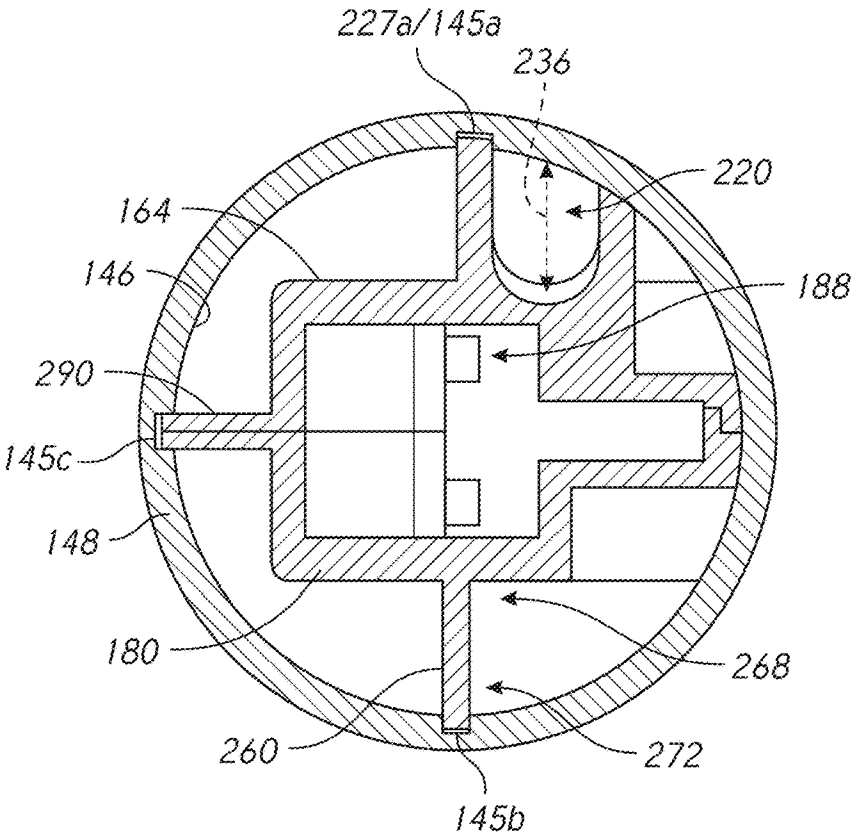
FIG. 8 is a cross-sectional view of the tilt assembly of FIG. 2 taken at section plane 8-8 shown in FIG. 3A.
Figure 9:
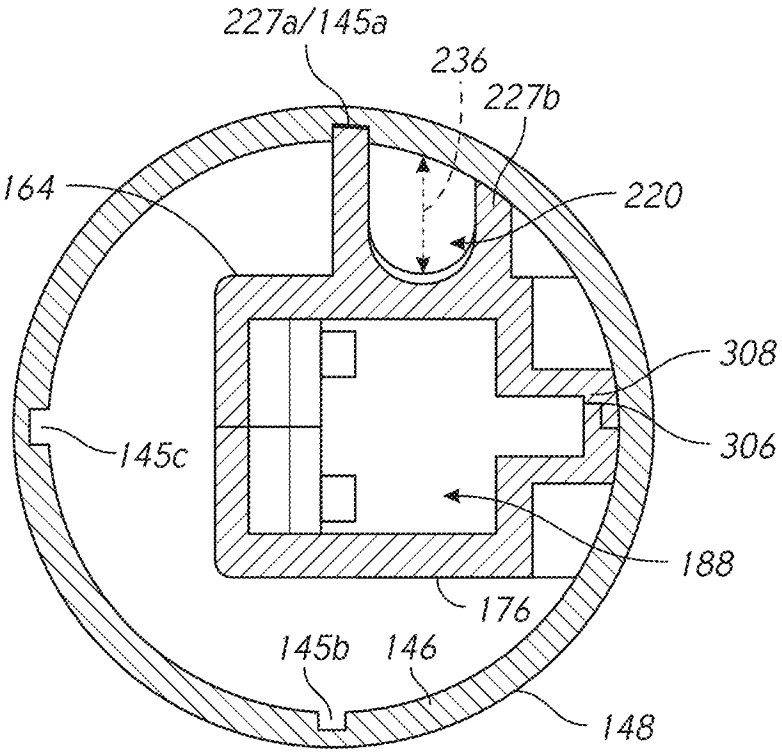
FIG. 9 is a cross-sectional view of the tilt assembly of FIG. 2 taken at section plane 9-9 shown in FIG. 3A.

FIGS. 7-10 show that the cord channel 220 is partly enclosed by the concave surface 226 and is partly enclosed by the inner wall 146 of the first tilt member 140. As discussed above, the lower portion 142 of the first tilt member 140 is adapted to have the first pole section 120 advanced thereover. The thickness of the first tilt member 140 between the inner wall 146 and the outer wall 148 separates the inside surface of the first pole section 120 from the cord 119 that would be disposed in the cord channel 220. The depth of the cord channel 220 varies along the length thereof. FIG. 9 shows that the cord channel 220 has a first depth 236 near a lower portion thereof. FIG. 8 shows that the cord channel 220 has a second depth 236 above the location of the first depth 236, the second depth 236 being greater than the first depth. FIG. 7 shows that the cord channel 220 can have a third depth 236 at an upper portion thereof that is greater than the second depth 236. The cord channel 220 can also be seen to be inclined inwardly in the first tilt member 140 such that an upper portion thereof is closer to the center of the first tilt member 140 than is a lower portion thereof. As a result, the cord path 238 can have an inclined configuration. The cord channel 220 can be inclined inwardly such that an upper portion thereof farther from the inner wall 146 than is a lower portion thereof. As a result, the cord path 238 can have an inclined configuration. A lower portion of the cord path 238 can be disposed more radially outwardly. An upper portion of the cord path 238 can be disposed more radially inwardly. In another aspect, the cord path 238 can be closer to a central longitudinal axis 242 of the first tilt member 140 in an upper portion 144 than in a lower portion 142. This configuration provides for space for the enclosed guide track 188 in the lower portion 142 yet allows the cord 119 to be in a more central position to allow for a less wear and lower friction arrangement for the cord 119.

FIGS. 7 and 8 shows that the guide track assembly 160 can include a flange 260 configure to provide positional stability in the first tilt member 140. The flange 260 can be configured to rotationally fix the guide track assembly 160 in the first tilt member 140. In one embodiment, the flange 260 is disposed on a side surface of the second guide track portion 180. The flange 260 can have a first end 268 adjacent to the side portion 184 and a second end 272 at a second location away from the side portion 184. The second end 272 can be configured to be received in an axial slot 145*b*, e.g., the axial slot 145*b* disposed at 6 o'clock in FIGS. 7 and 8. The flange 260 can be disposed on the first tilt member 140 opposite the cord channel 220. The second end 272 can be configured to be received in an axial slot 145*b* opposed to the axial slot 145*a* in which the first opposing section 227*a* is received.

In one embodiment, the guide track assembly 160 includes a flange assembly 290. The flange assembly 290 can comprise a first flange portion 292 and a second flange portion 296. The first flange portion 292 can be disposed on the first guide track member 164. The second flange portion 296 can be disposed on the second guide track member 176. The first flange portion 292 and the second flange portion 296 can be joined in a suitable manner. For example, each of the first flange portion 292 and the second flange portion 296 can include the peg 300 and the opening 304. The peg 300 on the second flange portion 296 can be configured to extend into the opening 304 on the first flange portion 292. In another embodiment, the peg 300 can be disposed on the first flange portion 292 and the opening 304 on the second flange portion 296. In one embodiment, a second opening 304 on the first flange portion 292 is aligned with a second opening 304 on the second flange portion 296. The second openings 304 can receive a fastener to enhance the connection of the first flange portion 292 to the second flange portion 296. In one embodiment, each of the first flange portion 292 and the second flange portion 296 has a peg 300 and an opening 304 configured to receive the peg 300.

FIGS. 7 and 8 show that the flange assembly 290 is configured to provide positional fixation of the guide track assembly 160 within the first tilt member 140. The flange assembly 290 can be configured to provide rotational fixation of the guide track assembly 160 in the first tilt member 140. The flange assembly 290 can be configured to be received in an axial slot 145*c*. The flange assembly 290 can be configured to extend into and engage the axial slot 145*c* located at 9 o'clock in FIGS. 7 and 8. FIG. 9 shows that the form of the guide track assembly 160 provides that the flange 260 and the flange assembly 290 need not extend to the lowermost end of the lower portion 142. Sufficient rotational and transverse stability and retention can be provided by providing that a length of the flange 260 that is less than a length of the guide track assembly 160. Sufficient rotational and transverse stability and retention can be provided by providing that a length of the flange assembly 290 that is less than a length of the guide track assembly 160.

In one embodiment, the guide track assembly 160 is securely received in the first tilt member 140 with three edges thereof affixed to corresponding axial slots 145*a-c*. A fourth side of the guide track assembly 160 can have a curved profile that engages the inner wall 146. The fourth side of the guide track assembly 160 can be convex with a curvature matching the concave inner wall 146. In other embodiments, a flange can be provided that would mate with an axial slot 145 (not shown) at a position opposite the flange assembly 290, e.g., at the 3 o'clock position.

Figure 5B:
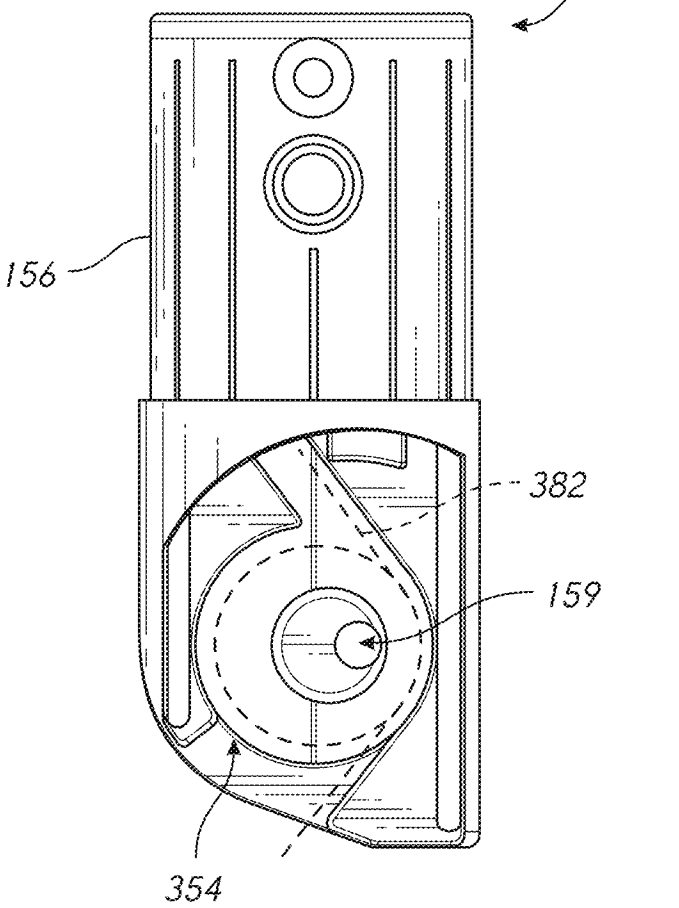
FIGS. 5A and 5B are side views of a tilt member of the tilt device of FIG. 2 that is tiltable in use.
Figure 5A:
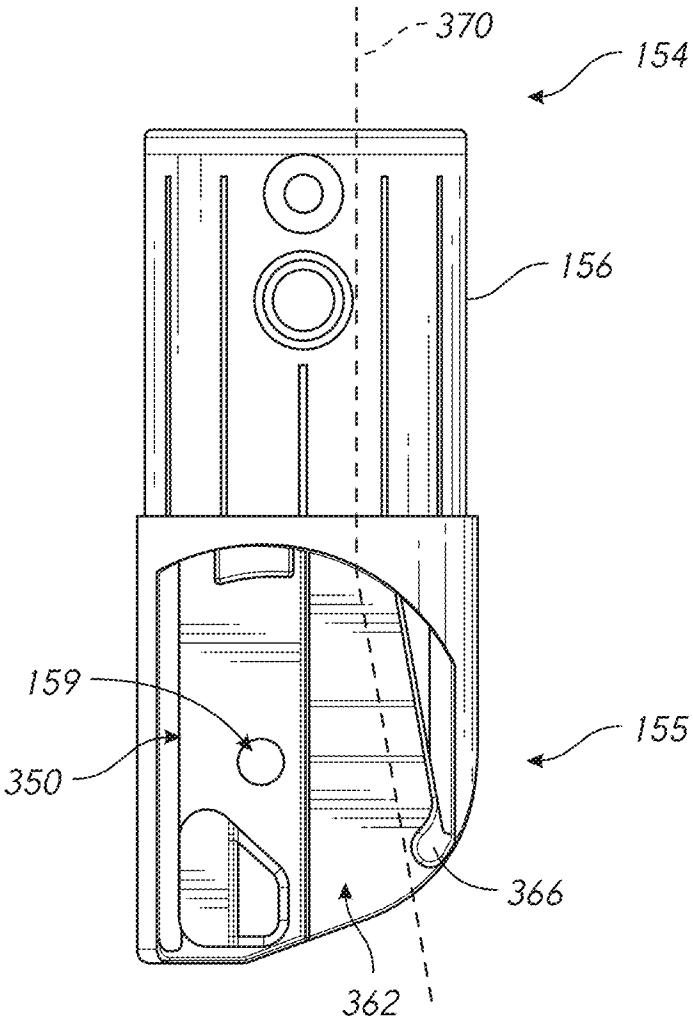

FIGS. 5A-6C show further details of various embodiment of the second tilt member 154. As discussed above, the second tilt member 154 is pivotably coupled with the first tilt member 140. FIGS. 5A and 5B show a first lateral side 350 and a second lateral side 354 of the lower portion 155 respectively. The first lateral side 350 includes a cord path cavity 362 which defines a portion of a tilting cord path 370. Although the cord path cavity 362 is exposed to the inside surface of the second pole section 124, this span of the cord path is closer to the center of the second tilt member 154 due to the inclined configuration of the concave surface 226. The tilting cord path 370 can be a continuation of the portion of the cord path 238 that is aligned with the longitudinal axis 242. However, as the dashed line in FIG. 5A shows the cord path tilting cord path 370 can include a non-zero acute angle change in direction from the upper part of the cord path 238 that is aligned with the longitudinal axis 242. The second tilt member 154 includes a cord path guide 366 disposed between the top of the cord channel 220 and a tilting cord channel 378 formed in the upper portion 156 of the second tilt member 154. The cord path guide 366 preferably has a smooth rounded face that guides motion of the cord 119 when the tilt device 104 is in a tilted configuration above a certain angle up to and including the largest angle of tilt.

FIG. 5B shows that the second lateral side 354 includes a spring cavity 358 in which a coiled spring 382 can be placed. The coiled spring 382 can take any form. Specific examples are discussed in U.S. Pat. No. 6,446,650, which is hereby incorporated by reference herein for this purpose and in its entirety. The coiled spring 382 can have one end coupled with the first tilt member 140 and a second end coupled with the second tilt member 154. As the tilt device 104 tilts, the coiled spring 382 is loaded storing strain energy. When the tilting is decreased the coiled spring 382 is unloaded or releases the stored strain energy at the same time urging the second tilt member 154 to an untilted configuration such as is shown in FIG. 3B.

Figure 6B:
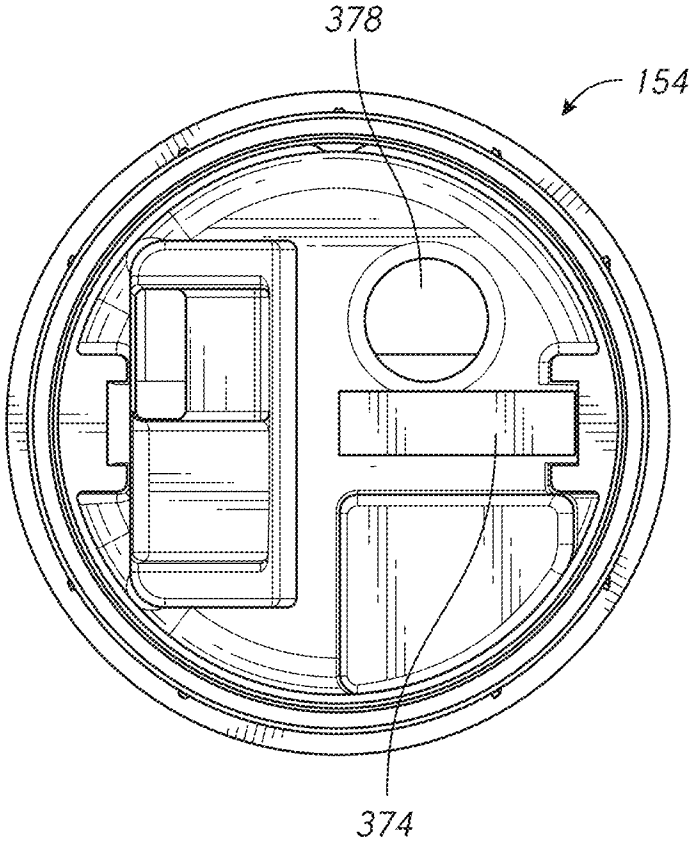
FIGS. 6A and 6B are top and bottom views of the tilt member of FIGS. 5A and 5B.
Figure 6A:
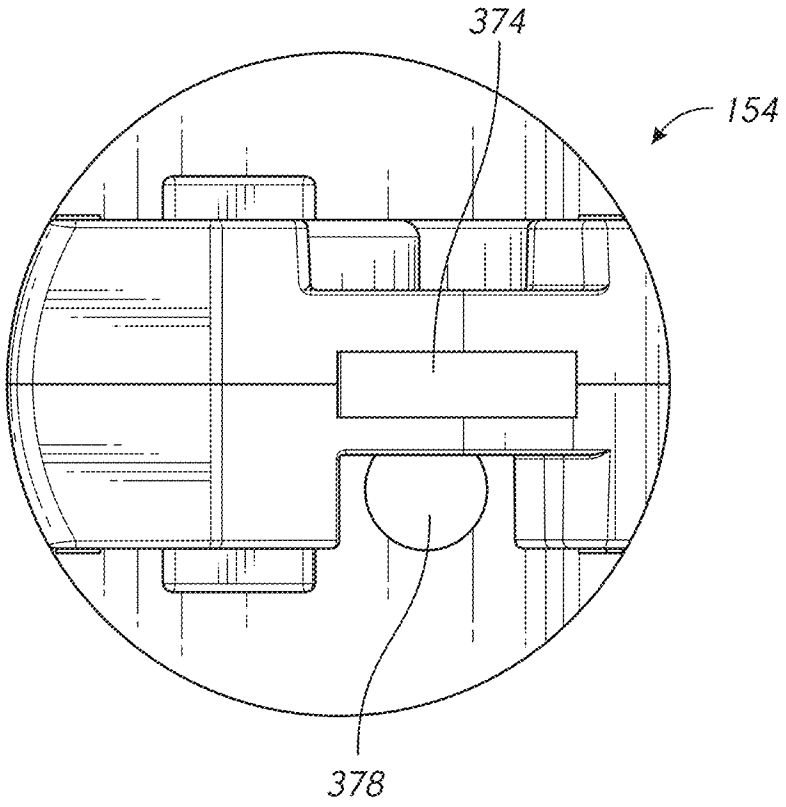

FIGS. 6A and 6B show that the tilting cord path 370 extends through a tilting cord channel 378 that is disposed through the second tilt member 154. Also, a driver channel 374 is disposed through the second tilt member 154. The driver channel 374 provides clearance for the driver 200. The driver channel 374 has a height (up and down in the view) that is slightly larger than the thickness of the driver 200 (but not by much to prevent the second tilt member 154 from contributing to sway of the umbrella 100). The driver channel 374 has a length (left and right in the view) that is than the width of the lower portion 208 of the driver 200 but not by much to prevent the second tilt member 154 from contributing to sway of the umbrella 100.

Figure 6C:
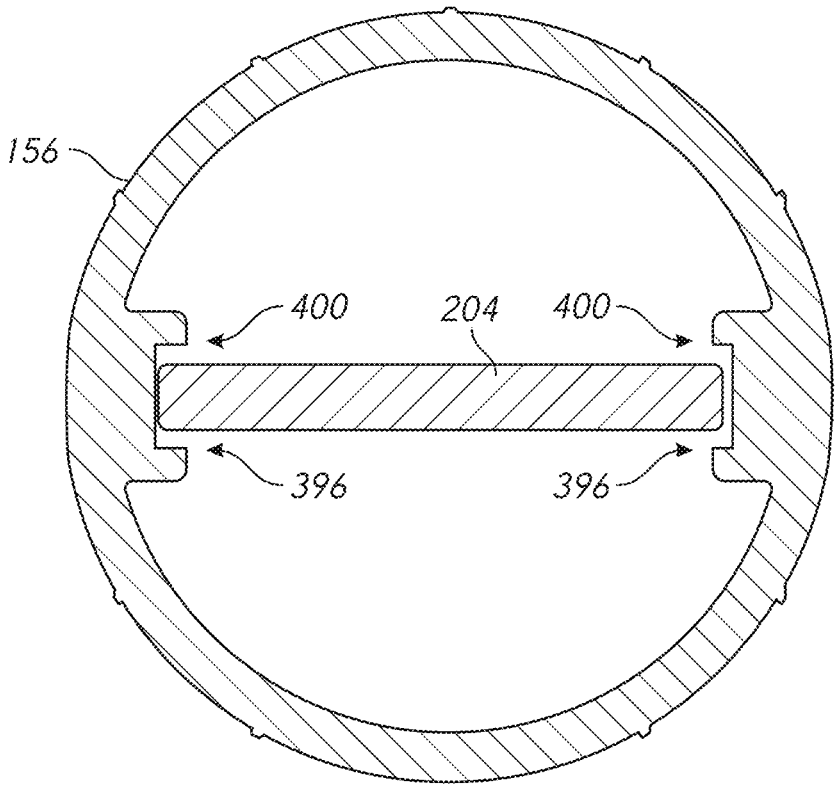
FIG. 6C is a cross-sectional view of the tilt assembly of FIG. 2 taken at section plane 6C-6C shown in FIG. 3B.

FIG. 6C shows that the upper portion 156 of the second tilt member 154 is adapted to guide the motion of the upper portion 204 of the driver 200. The upper portion can include one or a plurality of guides 396 that can slideably receive the upper portion 204 in at least one configuration. FIGS. 3B and 6C show that when the tilt device 104 is in an untilted position, the upper portion 204 can be received in two opposed guides 396. One lateral edge can be disposed in each of the opposing guides 396. Each of the guides 396 can include a C-shaped structure 400. The C-shaped structure 400 can provide for enclosing a lateral edge along at least a portion of the upper portion 204. The C-shaped structure 400 can help reduce sway of the umbrella 100 in any of the positions of tilting. The C-shaped structure 400 can comprise monolithic extension of a concave inner wall of the upper portion 156 second tilt member 154.

Operation of the umbrella 100 can be as follows. A crank handle of the winch 117 can be turned to pull the cord 119 through the tilt device 104 to wind the cord 119 within the winch 117. The cord 119 passes through the tilting cord path 370 and the cord channel 220 in the tilt device 104. The cord 119 can be moved along cord path guide 366 and along the concave surface 226 of the projection 224 as discussed above. The concave surface 226 can advantageously be formed of a low friction material and/or be made very smooth in view of it being accessible prior to inserting the guide track assembly 160 into the first tilt member 140. The concave surface 226 can be made of or can comprise a soft plastic, such as by a dipping or dip coating process. Further operation of the winch 117 raise the runner 116 from a position in which the runner 116 is at an elevation along the umbrella 100 in which it is over the first pole section 120. As the winch 117 is operated, the runner 116 can be raised up along the first pole section 120 and as the runner 116 is raised the canopy assembly 108 is expanded and opened. Further operation of the winch 117 causes the runner 116 to pass over the tilt device 104 to an elevation above the tilt device 104. Still further operation of the winch 117 causes the top of the runner 116 to engage with a bottom portion of the collar 332. As discussed above, the collar 332 is connected to the linking aperture 210 of the driver 200. As a result, the elevation of the collar 332 also raises the driver 200. Raising the driver 200 within the tilt device 104 causes the roller 312 to move along the enclosed guide track 188. The path defined in the enclosed guide track 188 causes movement of the driver 200 that results in tilting to the configuration of the umbrella 100 shown in FIG. 2 which corresponds to the configuration of the tilt device 104 shown in FIG. 3A. At higher degrees of tilting the cord 119 engages the cord path guide 366 which serves to provide a smooth low friction and low wear interface between the second tilt member 154 the cord 119.

By separating functions provided by the guide track assembly 160 from the structure of the first tilt member 140 advantages can be achieved. The first guide track member 164 and the second guide track member 176 are accessible during manufacturing and thus can be processed to be smoother than would be found in other forms of manufacturing, such as in inner core molding. This allows burrs and other irregularities that could lead to wear of the cord 119 and other components to be eliminated or reduced much more quickly than is possible with a monolithic molded part. Also, it is possible to make different parts within the tilt device 104 of different materials. The guide track assembly 160 can formed of more than one material. For example, the second guide track member 176 could include a rigid and wear resistant material. The first guide track member 164 could include a wear resistant material and/or a low friction material. Thus, the action of the roller 312 driven by the driver 200 will not create excessive wear on the enclosed guide track 188 and the concave surface 226 will be low friction and smooth to not create excessive wear on the cord 119. Moreover, the mating of the first guide track member 164 and the second guide track member 176 can create a close fit between the driver 200 and the enclosed guide track 188, e.g., providing minimal but a non-contact gap between the sides of the driver 200 and the inside periphery of the enclosed guide track 188. This reduces the contribution of these components to sway of the umbrella 100.

The tilt device includes a guide track assembly disposed in the first tubular body. The guide track assembly has a first guide track member having a first guide track portion disposed in a side portion thereof. The guide track assembly has a second guide track member having a second guide track portion disposed in a side portion thereof. The first guide track member and the second guide track member are separate members that are configured to mate at the side portions thereof. When so mated, the first and second guide track member join the second guide track portion to the first guide track portion to form an enclosed guide track. The tilt device includes a driver that has an upper portion disposed in the second tubular body and a lower portion disposed in the first tubular body. The enclosed guide track is configured to guide movement of the lower portion of the driver within the first tubular body. Movement of the driver causes the second tubular body to tilt relative to the first tubular body.

As used herein, the relative terms "top" and "bottom" shall be defined from the perspective of an upright vertically supported umbrella assembly. Thus, top or upper refers the direction toward the exposed side of the shade member 104 when so supported, while bottom or lower refers to the direction toward the mounting end 121 or the end 526.

Further example embodiments are set forth below.

Example 1: A tilt device for an umbrella, comprising: a first tilt member; a second tilt member pivotably coupled with the first tilt member; and a guide body removably disposed in the first tilt member, the guide body comprising a guide track disposed in or on the guide body, the guide track configured to guide movement of a cord of an umbrella in which the tilt device is disposed or to guide movement of a driver configured to cause the second tilt member to tilt relative to the first tilt member.

Example 2: The tilt device of example 1, wherein the guide body comprises a guide track assembly comprising a first guide track member and a second guide track member, the first guide track member and the second guide track member being separate members to provide access to a guide track, the first guide track member and the second guide track member configured to mate at the side portions thereof to enclosed the guide track therebetween.

Example 3: The tilt device of example 2, wherein the first guide track member comprises a first guide track portion disposed in a side portion thereof and the second guide track member comprises a second guide track portion disposed in a side portion thereof, the first guide track member and the second guide track member being mated at the side portions thereof to join the second guide track portion to the first guide track portion to form the enclosed guide track.

Example 4: The tilt device of examples 1-3, wherein the guide body comprises an open channel disposed on a side surface thereof.

Example 5: The tilt device of example 4, wherein the open channel is disposed in a projection disposed on the guide body, the projection including an elongate concave surface.

Example 6: The tilt device of example 5, wherein at least a portion of the elongate concave surface comprises a low friction material.

Example 7: The tilt device of examples 4-6, wherein the cord channel is enclosed by an inner wall of the first tilt member.

Example 8: The tilt device of examples 1-7, wherein the guide body comprises a flange disposed on at least one external surface thereof, the flange configured to rotationally fix the guide body within the first tilt member.

Example 9: The tilt device of example 8, wherein the flange has a first end adjacent to the guide track and a second end disposed away from the guide track, the second end configured to engage an inside surface of the first tilt member.

Example 10: The tilt device of example 9, wherein the second end of the flange is disposed in an axial slot located on the inside surface of the first tilt member.

Example 11: The tilt device of example 9, wherein the guide body comprises a first member having a first flange portion disposed thereon and a second member having a second flange portion disposed thereon, the first and second flange portions mating on an external surface of the guide body when the first and second members are coupled together.

Example 12: The tilt device of example 9, wherein the second flange portion comprises a peg and the first flange portion comprises an opening configured to receive the peg when the first member of the guide body is joined to the second member of the guide body.

Example 13: The tilt device of example 1-3, further comprising a driver having an upper portion disposed in the second tilt member and a lower portion disposed in the guide track, wherein the guide track is configured to guide movement of the lower portion of the driver within the first tilt member; wherein movement of the driver causes the second tilt member to tilt relative to the first tilt member.

Example 14: The tilt device of example 13, further comprising a first roller coupled with the lower portion of the driver and disposed in the guide track and a second roller coupled with the lower portion of the driver and disposed in the guide track.

Example 15: The tilt device of example 13, further comprising a collar coupled with the driver, the collar actuating the driver along the guide track within the guide body.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

The terms "approximately," "about," and "substantially" as used herein represent an amount close to the stated amount that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

Some embodiments have been described in connection with the accompanying drawings. However, it should be understood that the figures are not drawn to scale. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

For purposes of this disclosure, certain aspects, advantages, and novel features are described herein. It is to be understood that not necessarily all such advantages may be achieved in accordance with any particular embodiment.

Thus, for example, those skilled in the art will recognize that the disclosure may be embodied or carried out in a manner that achieves one advantage or a group of advantages as taught herein without necessarily achieving other advantages as may be taught or suggested herein.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Further, the actions of the disclosed processes and methods may be modified in any manner, including by reordering actions and/or inserting additional actions and/or deleting actions. Thus, it is intended that the scope of at least some of the present inventions herein disclosed should not be limited by the particular disclosed embodiments described above. The limitations in the claims are to be interpreted broadly based on the language employed in the claims and not limited to the examples described in the present specification or during the prosecution of the application, which examples are to be construed as non-exclusive.

What is claimed is:

1. A tilt device for an umbrella, comprising:

a first tilt member;

a second tilt member pivotably coupled with the first tilt member;

a guide track assembly disposed in the first tilt member, the guide track assembly comprising a first guide track member having a first guide track portion disposed therein and a second guide track member having a second guide track portion disposed therein, the first guide track member and the second guide track member being separate members configured to mate to form an enclosed guide track;

a driver having a first portion disposed in the second tilt member and a second portion disposed in the enclosed guide track, wherein the enclosed guide track is configured to guide movement of the second portion of the driver within the first tilt member;

wherein movement of the driver causes the second tilt member to tilt relative to the first tilt member;

wherein the guide track assembly comprises a flange disposed on at least one external surface thereof, the flange configured to rotationally fix the guide track assembly within the first tilt member.

2. The tilt device of claim 1, wherein the flange is disposed on a side surface of the second guide track member, the flange having a first end adjacent to the second guide track portion and a second end at a second location away from the second guide track portion.

3. The tilt device of claim 2, wherein the flange is disposed on a side of the guide track assembly opposite a cord channel.

4. The tilt device of claim 1, wherein the flange comprises a first flange portion disposed on the first guide track member and a second flange portion disposed on the second guide track member, the first and second flange portions mating on an external surface of the guide track assembly.

5. The tilt device of claim 4, further comprising a first roller coupled with the second portion of the driver and disposed in the first guide track portion and a second roller coupled with the second portion of the driver and disposed in the second guide track portion.

6. The tilt device of claim 1, further comprising a slideable collar disposed over the second tilt member and coupled with the first portion of the driver such that sliding movement of the collar along the second tilt member moves the second portion of the driver along the enclosed guide track.

7. An umbrella, comprising:

a canopy assembly comprising a plurality of ribs and struts;

an umbrella pole supporting the canopy assembly and including:

a first pole section;

a second pole section hingedly coupled with the first pole section;

a guide track assembly disposed in the first pole section, the guide track assembly comprising a first member and a second member, the first member and the second member being separate members configured to mate at respective side portions thereof, an enclosed guide track being disposed within the guide track assembly; and a driver having a first portion disposed in the second pole section and a second portion configured to be guided by the enclosed guide track, such that movement of the driver tilts the second pole section relative to the first pole section;

wherein the guide track assembly comprises a flange disposed on at least one external surface thereof, the flange configured to rotationally fix the guide track assembly within the first pole section.

8. The umbrella of claim 7, further comprising a collar slideably disposed over the umbrella pole and coupled with the first portion of the driver such that movement of the collar along the umbrella pole moves the second portion of the driver along the enclosed guide track.

9. The umbrella of claim 7, wherein the first pole section comprises a first elongate tubular member and a first tilt member and the second pole section comprises a second elongate tubular member and a second tilt member.

10. The umbrella of claim 7, wherein the flange is disposed on a side surface of the second guide track member, the flange having a first end adjacent to the second guide track portion and a second end at a second location away from the second guide track portion.

11. The umbrella of claim 7, wherein the flange is disposed on a side of the guide track assembly opposite a cord channel.

12. The umbrella of claim 7, wherein the flange comprises a first flange portion disposed on the first guide track member and a second flange portion disposed on the second guide track member, the first and second flange portions mating on an external surface of the guide track assembly.

13. The umbrella of claim 12, further comprising a first roller coupled with the second portion of the driver and disposed in the first guide track portion and a second roller coupled with the second portion of the driver and disposed in the second guide track portion.

14. The umbrella of claim 7, further comprising a winch and a crank coupled with a cord and configured to open and close the canopy assembly.

15. An umbrella, comprising:

a canopy assembly;

a first pole section;

a second pole section disposed between the first pole section and the canopy assembly;

a guide track assembly disposed in the first pole section, the guide track assembly comprising a first member and a second member, the first member and the second member being separate members configured to mate at respective side portions thereof, an enclosed guide track being disposed within the guide track assembly;

a driver having a first portion disposed in the second pole section and a second portion configured to be guided by the enclosed guide track, such that movement of the driver tilts the second pole section relative to the first pole section;

wherein the enclosed guide track is configured to guide the second portion of the driver from a first end of the enclosed guide track to a second end of the enclosed guide track and along a plane at or parallel to a mating surface between the side portions of the guide track assembly.

16. An umbrella, comprising:

a canopy assembly;

a first pole section;

a second pole section disposed between the first pole section and the canopy assembly;

a guide track assembly disposed in the first pole section, the guide track assembly comprising a first member and a second member, the first member and the second member being separate members configured to mate at respective side portions thereof, an enclosed guide track being disposed within the guide track assembly such that from a first end of the enclosed guide track to a second end of the enclosed guide track, the entire length of the enclosed guide track is disposed on both the first member and the second member;

a driver having an first portion disposed in the second pole section and a second portion configured to be guided by the enclosed guide track, such that movement of the driver tilts the second pole section relative to the first pole section.

* * * * *